US007505020B2

(12) United States Patent
Yamamoto et al.

(10) Patent No.: US 7,505,020 B2
(45) Date of Patent: Mar. 17, 2009

(54) DISPLAY DEVICE DRIVING CIRCUIT, DISPLAY DEVICE, AND DRIVING METHOD OF THE DISPLAY DEVICE

(75) Inventors: Etsuo Yamamoto, Matsusaka (JP); Seijirou Gyouten, Matsusaka (JP); Sachio Tsujino, Matsusaka (JP); Hoh Riku, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 779 days.

(21) Appl. No.: 10/923,077

(22) Filed: Aug. 23, 2004

(65) Prior Publication Data

US 2005/0052443 A1 Mar. 10, 2005

(30) Foreign Application Priority Data

Aug. 22, 2003 (JP) ..... 2003-299236
Jul. 29, 2004 (JP) ..... 2004-222523

(51) Int. Cl.
*G09G 3/36* (2006.01)

(52) U.S. Cl. ..... 345/98; 345/100

(58) Field of Classification Search ..... 345/87, 345/98, 100, 103, 211, 212, 213
See application file for complete search history.

(56) References Cited

U.S. PATENT DOCUMENTS 4,549,172 A * 10/1985 Welk ..... 345/22
5,532,713 A * 7/1996 Okada et al. ..... 345/97
5,764,207 A 6/1998 Maekawa et al.
6,483,494 B1 * 11/2002 Liaw et al. ..... 345/92
6,559,824 B1 * 5/2003 Kubota et al. ..... 345/100
6,836,269 B2 * 12/2004 Maeda et al. ..... 345/212
6,870,553 B2 * 3/2005 Kondo et al. ..... 345/690
2002/0015032 A1 2/2002 Koyama et al.
2002/0175905 A1 * 11/2002 Matsumoto ..... 345/204
2003/0006955 A1 * 1/2003 Tsuchi ..... 345/92
2003/0095117 A1 * 5/2003 Katagawa et al. ..... 345/208
2003/0151616 A1 * 8/2003 Morita ..... 345/690

FOREIGN PATENT DOCUMENTS

JP 5-75957 A 3/1993
JP 7-295521 A 11/1995
JP 10-105126 A 4/1998
JP 11-160730 A 6/1999
JP 11-175041 A 7/1999

(Continued)

*Primary Examiner*—Amr Awad
*Assistant Examiner*—Jeff Pelligrino
(74) *Attorney, Agent, or Firm*—Nixon & Vanderhye P.C.

(57) ABSTRACT

A simultaneous precharge type display device source driver includes supply control circuits each of which is provided on each of source bus lines. Each of the supply control circuits receives (a) a precharge control signal for precharging each of the source bus line and (b) a sampling control signal for writing data, which should be written on pixels, onto the source bus line. The one of two switches turns ON in response to the precharge control signal and the sampling control signal. The other of the switches turns ON in response to the sampling control signal. In the sampling operation, both the switches are turned ON so as to quicken the writing operation. In the precharge operation, the other switch does not operate, so that it is possible to reduce the power consumption.

25 Claims, 12 Drawing Sheets

FOREIGN PATENT DOCUMENTS

| | | | |
|---|---|---|---|
| JP | 11-202296 | A | 7/1999 |
| JP | 11-218738 | A | 8/1999 |
| JP | 2000-98982 | A | 4/2000 |
| JP | 2000-206491 | A | 7/2000 |
| JP | 2003-108093 | A | 4/2003 |
| JP | 2003-162263 | A | 6/2003 |

* cited by examiner

DISPLAY DEVICE DRIVING CIRCUIT, DISPLAY DEVICE, AND DRIVING METHOD OF THE DISPLAY DEVICE

This Nonprovisional application claims priority under 35 U.S.C. § 119(a) on Patent Application No. 2003/299236 filed in Japan on Aug. 22, 2003 and Patent Application No. 2004/222523 filed in Japan on Jul. 29, 2004, the entire contents of which are hereby incorporated by reference.

FIELD OF THE INVENTION

The present invention relates to a driving circuit of a dot-sequential driving system display device, a display device using the driving circuit, and a driving method of the display device.

BACKGROUND OF THE INVENTION

A line-sequential driving system is known as one of driving methods adopted in an active matrix liquid crystal display device. This is such system that driving signals are simultaneously written on source bus lines respectively connected to a plurality of pixels on a display panel during a period in which a single gate bus line is turned ON.

While, as a dot-sequential driving system, it is known that driving voltages corresponding to video signals are sequentially written on each block constituted of one or more source bus lines only at a predetermined period. Here, each of the divided blocks may include a single bus line, or may include a plurality of bus lines, e.g., three bus lines of RGB (Red, Green, Blue).

Here, in case of adopting the dot-sequential driving system, it is not necessary to simultaneously write driving signals, so that it is not necessary to provide a buffer circuit for temporarily holding signals unlike a line-sequential driving system. Thus, the dot-sequential driving system is adopted in a display panel manufactured with silicon such as LPS (Low-Temperature poly-Silicon) which is considered to make it difficult to manufacture a buffer circuit for example.

In the dot-sequential driving system, a time in which voltages can be written on pixels is shorter than in the line-sequential driving system. This is because the writing is possible only during a period shorter than a period obtained by dividing a selection period of a single horizontal line by the number of blocks as described above.

Further, a liquid crystal display device uses an inversion driving system such as a line inversion driving system in order to reduce flickers. In this case, voltages having different polarities are written on a single source bus line in respective horizontal periods, so that it takes time to write these voltages.

Thus, it is often that a precharge system for precharging source bus lines is adopted together with the dot-sequential driving system. For example, in a simultaneous precharge system performed as the foregoing precharge system, precharge voltages are simultaneously supplied to respective source bus lines during a horizontal line period in which all the gate bus lines are turned OFF. Thus, it is possible to write actual signal voltages even in a short time.

Here, a source driver of a conventional display device using the dot-sequential driving system is arranged so that a supply control circuit shown in FIG. 6 is provided on each source bus line. To the supply control circuit, a precharge control signal which reaches an ON-level only during a retrace line period and a sampling control signal which reaches an ON-level only during a period in which data to be written on pixels are written (sampling period) are inputted.

According to the arrangement of the supply control circuit shown in FIG. 6, a switch E25 turns ON during a period in which either the precharge control signal or the sampling control signal reaches an ON-level, so that a data signal is supplied to the source bus line. In this manner, the precharge control signal is caused to reach an ON-level during the precharge period, and a precharge voltage is supplied as the video signal. Further, in writing voltages on the pixels, the sampling control signal is caused to reach an ON-level, and the video signal is written.

Arrangements of a display device and a driving circuit each of which has the foregoing supply control circuit are respectively disclosed in Japanese Unexamined Patent Publication No. 105126/1998 (Tokukaihei 10-105126)(Publication date: Apr. 24, 1998) and Japanese Unexamined Patent Publication No. 175041/1999 (Tokukaihei 11-175041)(Publication date: Jul. 2, 1999).

Note that, Japanese Unexamined Patent Publication No. 206491/2000 (Tokukai 2000-206491)(Publication date: Jul. 28, 2000) discloses not the simultaneous precharging system but an arrangement in which two switches (a data signal switch and a precharge control signal switch) are provided on each bus line.

However, according to the conventional arrangement shown in FIG. 6, in precharging the bus lines, also peripheral circuits operate in the same manner as in the sampling. This raises such problem that power is unnecessarily consumed.

That is, in case of using the simultaneous precharge system in the dot-sequential driving, a writing time (time taken to carry out the writing operation) in the precharge and a writing time in the sampling are greatly different from each other. Thus, like the conventional arrangement, when the circuits operate as before though the writing time is different, a current excessively flows in the precharge operation, so that power is unnecessarily consumed.

SUMMARY OF THE INVENTION

The present invention was devised in the foregoing view point, and its object is to provide (i) a display device driving circuit which reduces power consumption in dot-sequential driving, (ii) a display device, and (iii) a driving method of the display device.

In order to solve the foregoing problem, the display device driving circuit according to the present invention includes supply control circuits each of which supplies a voltage to each of source bus lines connected to pixels of a display device, wherein each of the supply control circuits includes: a sampling circuit section for supplying the voltage to the source bus line in response to a sampling control signal for writing data of the pixels on the source bus line; and a precharge circuit section for supplying the voltage to the source bus line in response to the sampling control signal and for supplying the voltage to the source bus line in response to one or more precharge control signals for precharging the source bus line.

The display device driving circuit includes the supply control circuit provided on each source bus line. The supply control circuit supplies a voltage to the source bus line connected to the pixels of the display device. A single gate bus line is turned ON by a display device gate driver for example, so that the writing is possible in the pixels. Then, the supply control circuit of the driving circuit supplies a voltage to each source bus line, thereby carrying out the writing operation on the pixels. The gate bus lines are sequentially made to be under a writable condition, and the writing operation is carried out on the respective pixels during this time, so that an image is displayed on an entire screen of the display device.

The supply control circuit causes a predetermined switch to turn ON/OFF in response to an inputted control signal for example, so as to cause a voltage to or not to be supplied to the source bus line. For example, the switch is turned ON during a period in which the control signal is high, so as to supply a voltage. During a period in which the control signal is low, the switch is turned OFF. Of course, other arrangement may be adopted instead of the arrangement in which ON/OFF of the switch causes a voltage to be supplied in response to the control signal.

The supply control circuit arranged in the foregoing manner receives a sampling control signal and a precharge control signal as the control signal. The sampling control signal is a control signal for writing data of the pixels on the source bus line. The precharge control signal is a control signal for precharging the source bus line. The sampling control signal and the precharge control signal are different from each other.

Further, the supply control circuit includes a sampling circuit section and a precharge circuit section. The sampling circuit section turns ON/OFF in response to the sampling control signal for example, so as to supply a voltage. The precharge circuit section turns ON/OFF in response to the sampling control signal and the precharge control signal for example, so as to supply a voltage. That is, the sampling control signal causes the sampling circuit section and the precharge circuit section to supply voltages, and the precharge control signal causes the precharge circuit section to supply a voltage.

Thus, in the precharge based on the precharge control signal, only the precharge circuit section is operated, and the sampling circuit section is not operated, so that it is possible to reduce power consumption corresponding to the operation of the sampling circuit section.

Further, in the sampling based on the sampling control signal for example, both the sampling circuit section and the precharge circuit section operate. When a current supplying ability in this case is set to be the same as a current supplying ability of a conventional supply control circuit, the power consumption is not increased in the sampling.

Therefore, by using the driving circuit, it is possible to totally reduce the power consumption of the display device.

Note that, it is also possible to describe the aforementioned display device driving circuit as follows. That is, the display device driving circuit is arranged so that: a precharge control switch is controlled by an OR signal of a precharge control signal and a sampling control signal, and a sampling control switch is controlled by the sampling control signal, and a precharging operation is carried out by turning ON only the precharge control switch, and a sampling operation is carried out by turning ON both the precharge control switch and the sampling control switch.

In order to achieve the foregoing object, the display device according to the present invention includes the aforementioned driving circuit.

The power consumption of the driving circuit can be reduced, so that it is possible to provide the display device whose power consumption is reduced.

In order to achieve the foregoing object, the display device driving method according to the present invention, in which a first control signal and a second control signal are inputted to switch circuits provided on each of source bus lines connected to pixels of a display device so as to cause a voltage to or not to be supplied to the source bus line, includes: a precharging step in which the first control signal is simultaneously inputted to a first group of the switch circuits so as to supply the voltage to the source bus line so that the source bus line is precharged; and a writing step in which the second control signal is inputted to a second group of one or more switch circuits fewer than the switch circuits of the first group so as to supply the voltage to the pixels via the source bus line, wherein: each of the switch circuits includes a plurality of switches, and at least a part of the switches is turned ON in response to the first and second control signals in the precharging step and the writing step respectively, and a number of the switches turned ON in the precharging step and a number of the switches turned ON in the writing step are different from each other.

In the display device using the driving method displays an image as follows. For example, the gate driver turns ON a single gate bus line. Further, on the side of the source bus line, a control signal is inputted to switch circuits, so that a voltage is supplied to each source bus line, thereby writing data on the pixels. The gate driver sequentially turns ON the gate bus lines so as to carry out the writing operation on the pixels from the source bus lines, thereby displaying an image in the display device.

In more detail, in the aforementioned driving method, the control signal is simultaneously inputted to a plurality of switch circuits, so as to precharge the respective source bus lines (precharging step). Further, the control signal is inputted to the switch circuits, so that data which should be written on the pixels is written onto the source bus line and the data is written on the pixels (writing step).

For example, in the precharging step, the control signal is inputted to all the switch circuits and all the source bus lines are precharged. In the writing step, the control signal is inputted to each switch circuit, or each group of switch circuits connected to three source bus lines of R, G, and B, or each group of more switch circuits, and data which should be written on the pixels are written on the source bus lines and the data are written on the pixels. Note that, in the precharging step, even in the case of the simultaneous precharge, it is not necessary to simultaneously input the control signals to all the switch circuits, but it may be so arranged that: all the switch circuits are divided into a plurality of groups and the control signals are inputted to the groups respectively.

Thus, the precharging step and the writing step are different from each other in terms of a writing time (a time taken to carry out the writing). That is, it is possible to obtain a larger writing time in the precharging step than in the writing step. Therefore, the precharging step and the writing step are different from each other also in terms of (a) the most appropriate writing ability required in appropriately carrying out the writing operation in the writing time and (b) a current flowing in the writing operation.

Here, the power consumption in the writing operation depends on a current flowing in the writing operation. The current flowing in the writing operation depends on a resistance along a current path. Further, due to at least an (ON) resistance of a switch, a different switch to be turned ON results in a different resistance along a current path.

Thus, the number of the switches turned ON in the precharging step and the number of the switches turned ON in the writing step are different from each other, and a switch is appropriately selected in the precharging step and in the writing step respectively, so that it is possible to select an appropriate current in each period, thereby optimizing the writing operation and reducing the power consumption.

DESCRIPTION OF THE EMBODIMENTS

Embodiment 1

The following description will explain one embodiment of the present invention with reference to FIG. 1 to FIG. 5.

Figure 2:
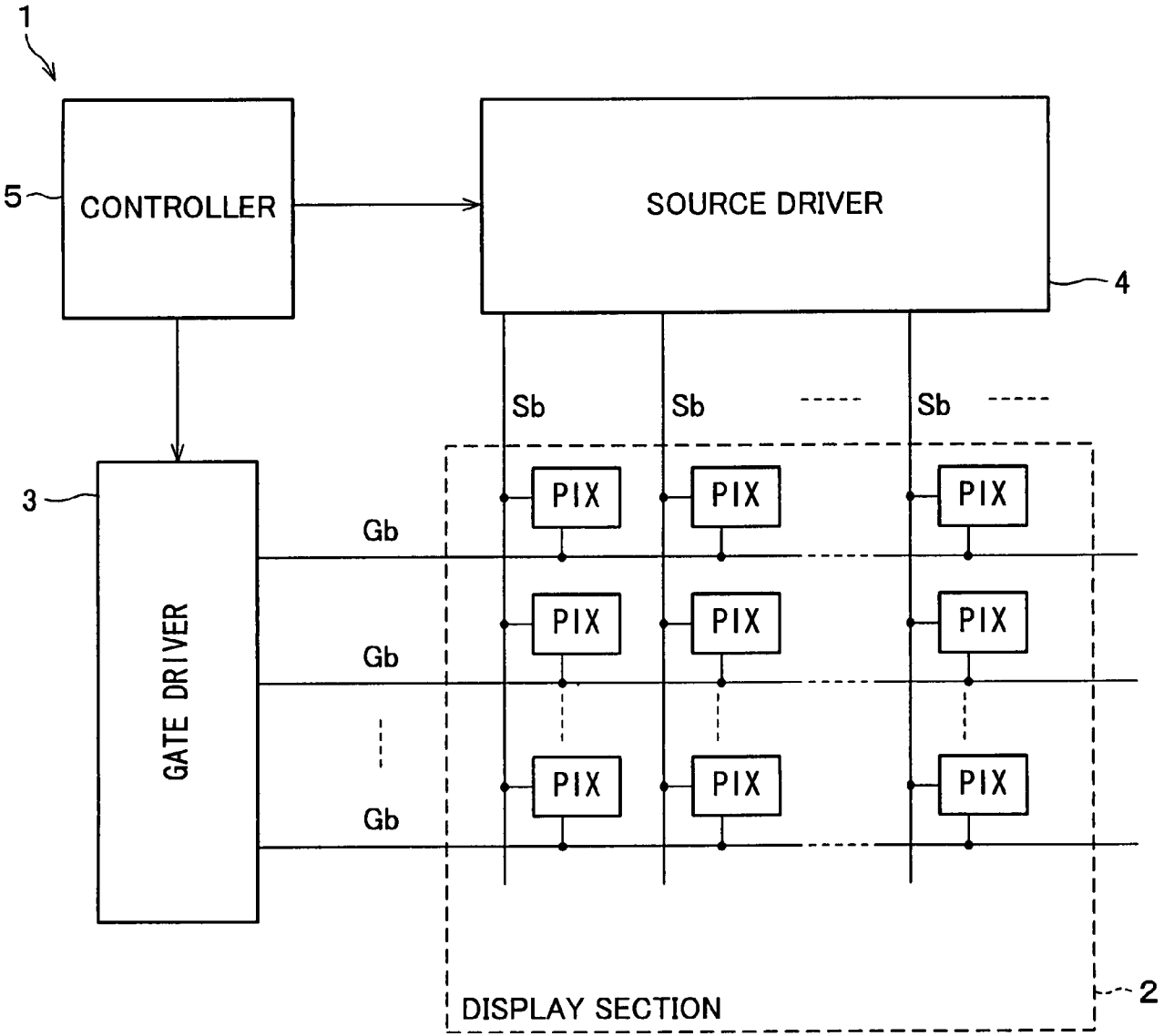
FIG. 2 is a block diagram showing an example of a display device according to the present invention.

As shown in FIG. 2, a liquid crystal display device (display device) 1 of the present embodiment includes a display section 2, a gate driver 3, a source driver 4, and a controller 5.

The liquid crystal display device 1 displays an image, corresponding to an inputted video signal, in the display section 2.

The display section 2 is an active matrix display section, and includes a plurality of source bus lines Sb, a plurality of gate bus lines Gb crossing the source bus lines Sb, glass substrates (not shown), and pixels PIX disposed in a matrix manner. Each of the pixels PIX is constituted of a pixel capacitor Cp and a pixel transistor, and the pixel capacitor is constituted of a liquid crystal capacitor and an auxiliary capacitor. In the display section 2, a liquid crystal layer functions as the pixel capacitor is sandwiched by the glass substrates, and each of electrodes provided on the glass substrates applies a voltage to the liquid crystal, so as to display an image.

Each of the gate bus lines Gb of the display section 2 is connected to the gate driver 3, and each of the source bus lines Sb is connected to the source driver 4. Each of the pixel transistors is provided on one of the glass substrates, and its gate is connected to the gate bus line Gb, and its source is connected to the source bus line Sb, and its drain is connected to the pixel capacitor. A voltage from a drain of the transistor provided on one of the glass substrates and a voltage from a power source circuit (not shown) provided on the other of the glass substrates are respectively applied to the pixel capacitor.

The gate driver 3 turns ON pixel transistors corresponding to a specified single line (corresponding to a single gate bus line Gb) in the display section 2 at a predetermined timing.

The source driver 4 supplies a data signal to the source bus line Sb of the display section 2 in response to a control signal from the controller 5.

The controller 5 is to send control signals to the gate driver 3 and the source driver 4. The controller 5 generates the control signals, sent to the gate driver 3 and the source driver 4, in response to an inputted signal (not shown), so as to output the control signals to the gate driver 3 and the source driver 4.

When a video signal, display data, and the like are inputted from the outside to the liquid crystal display device 1 arranged in the foregoing manner, the data signal is inputted to the source driver 4 via a circuit such as DAC (Digital Analog Converter) or the like as required. Further, the controller 5 sends the control signals to the gate driver 3 and the source driver 4 at a predetermined timing.

Writing for each line of the gate bus lines Gb is carried out over a single horizontal period in the following manner. First, the gate driver 3 outputs a gate pulse to the gate bus line Gb of the display section 2, in response to the control signal sent from the controller 5, at the same timing as operation of the source driver 4. This causes pixel transistors, provided on the display section 2, which correspond to a specified single line, to turn ON for a predetermined period.

While, the source driver 4 supplies a data signal for each line, corresponding to a video signal, to the source bus line Sb of the display section 2, in response to the control signal sent from the controller 5. The gate driver 3 sequentially turns ON the respective gate lines, and the source driver 4 outputs the respective data signals. This operation is repeated, so that a video corresponding to the video signal is displayed in the display section 2 of the liquid crystal display device 1.

Figure 3:
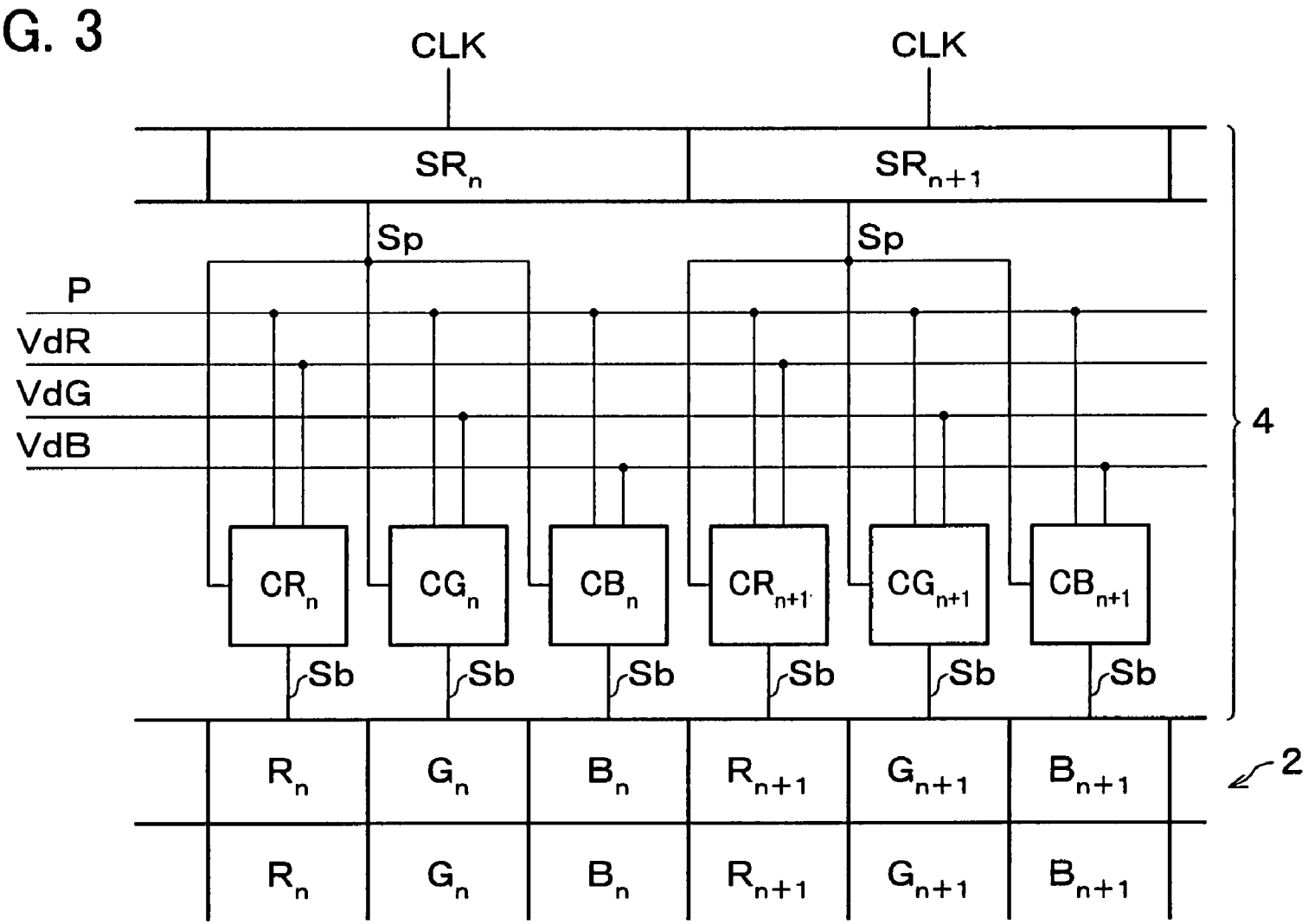
FIG. 3 is a block diagram showing other part of the driving device.

Here, an example of an arrangement of the aforementioned source driver 4 is detailed as follows. The source driver 4 is a driving circuit using a dot-sequential driving system for every three lines of R, G, B (Red, Green, Blue). Further, the source driver 4 is a driving circuit using a line inversion driving system. Further, the source driver 4 is a driving circuit using a simultaneous precharge system, As shown in FIG. 3, the source driver 4 includes shift registers SR (SRn, SRn+1) and supply control circuits (switch circuits) C (CRn, CGn, CBn, CRn+1, CGn+1, CBn+1). Note that, in order to facilitate the description, FIG. 3 shows mere two lines each of which is constituted of (i) n-th source bus lines Sb (Sb respectively connected to Rn, Gn, and Bn) and (ii) n+1st source bus lines Sb (Sb respectively connected to Rn+1, Gn+1, and Bn+1) corresponding to R, G, and B. However, all the N source bus lines are arranged in the same manner.

The source bus lines Sb extending from the source driver 4 are connected to the pixels PIX (Rn, Gn, Bn, Rn+1, Gn+1, Bn+1) of the display section 2. The source bus lines Sb are provided so as to correspond to the number of the pixels PIX provided on the display section 2. Further, the supply control circuit C is provided on each source bus line Sb so as to correspond to the source bus line Sb.

To the shift register SR of the source driver 4, a start pulse (not shown) and a clock CLK are supplied. The inputted start pulse is sequentially sent to the respective shift registers SR in accordance with each clock CLK. A sampling control signal Sp outputted from the shift register SR is outputted to the supply control circuits C. In more detail, the source driver 4 uses the dot-sequential driving system for every three dots, and an output of the shift register SRn positioned at an n-th stage is supplied to the supply control circuits CRn, CGn, and CBn which are positioned at an n-th stage.

To the supply control circuits C, the sampling control signal Sp from the shift register SR, the precharge control signal P from the controller 5, and the data signals Vd (VdR, VdG, VdB) for respective colors are supplied. Here, the single sampling control signal Sp from the shift register SRn is supplied to the supply control circuits C (CRn, CGn, CBn), but different data signals (VdR, VdG, VdB) are respectively supplied to the supply control circuits C (CRn, CGn, CBn). Further, the precharge signal P is supplied to the supply control circuits C at the respective stages so as to be shared by these supply control circuits C. Each of the supply control circuits C outputs the data signal Vd to each source bus line Sb in response to an inputted signal.

In this manner, in case of carrying out the simultaneous precharge in the dot sequential driving system for every three dots, the single precharge control signal P is supplied to a plurality of the supply control circuits C, whereas different sampling control signals Sp are supplied to the respective blocks each of which includes three supply control circuits CRn, CGn, CBn.

Figure 1:
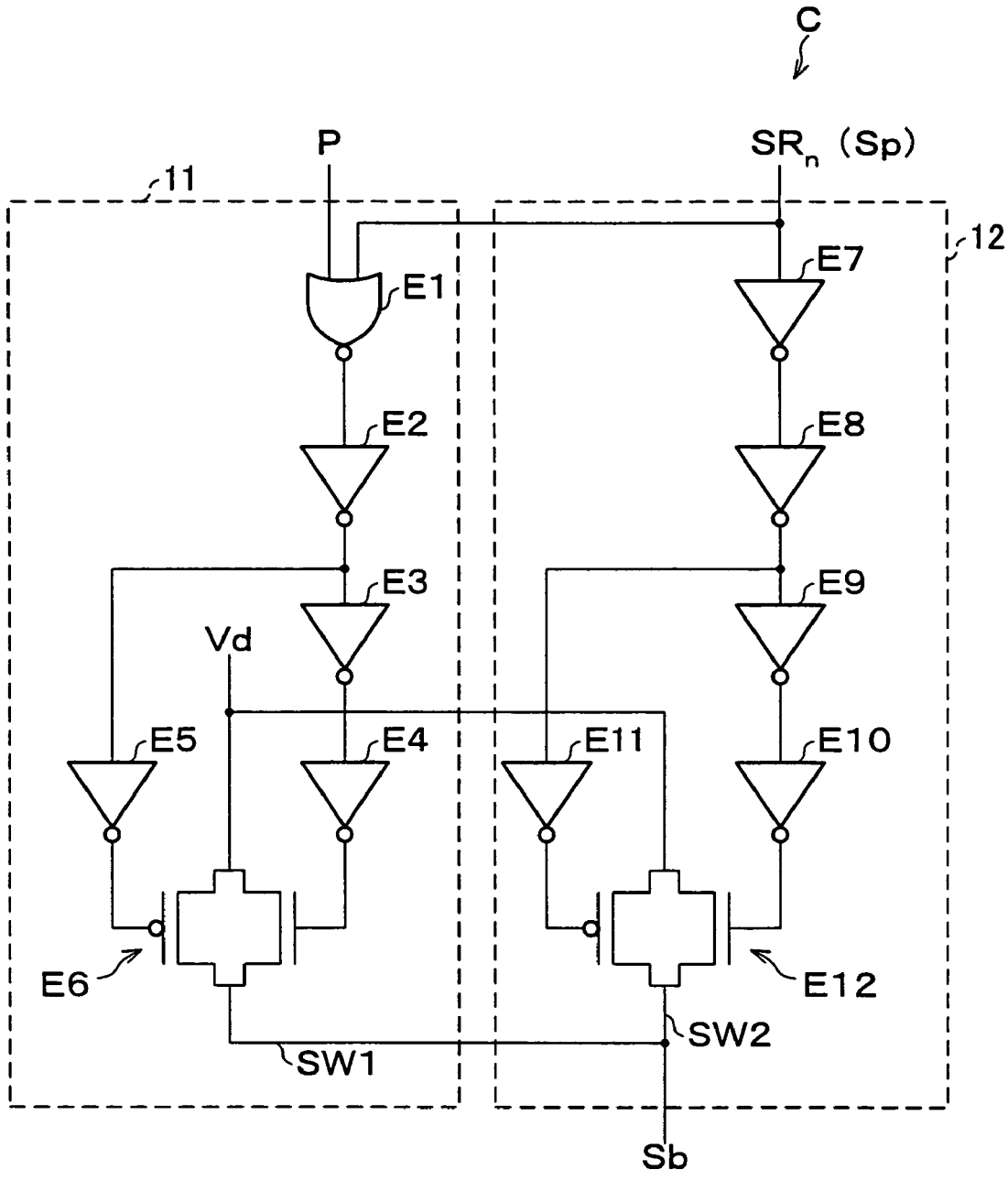
FIG. 1 is a logic circuit diagram showing a part of an example of a display device driving circuit according to the present invention.

In more detail, as shown in FIG. 1, the supply control circuit C includes a NOR gate E1, inverters E2 to E5 and E7 to E11, switches E6 and E12, as semiconductor elements E1 to E12. Further, the supply control circuit C receives the precharge control signal P and the sampling control signal Sp, so as to turn ON/OFF a switch (second switch) E6 and a switch (first switch) E12, each of which is constituted of a transfer gate, via the semiconductor elements E1 to E5 and E7 to E11 which function as logic elements. Further, the supply control circuit C receives the data signal Vd, and the switches E6 and E12 cause the data signal to or not to be supplied to the source bus line Sb. The inverters E2 to E5 function as buffer circuits of the switch E6, and the inverters E7 to E11 function as buffer circuits of the switch E12.

Here, the semiconductor elements E7 to E12 correspond to a sampling circuit section 12 for supplying the data signal Vd to the source bus line Sb in response to the sampling control signal Sp sent from the shift register SRn. When a level of the sampling control signal Sp is high, the switch E12 turns ON, so as to supply the data signal Vd to the source bus line Sb as an output SW2. When the level of the sampling control signal Sp is low, the switch E12 turns OFF.

Further, the semiconductor elements E1 to E6 correspond to a precharge circuit section 11 for supplying the data signal Vd to the source bus line Sb in response to the sampling control signal Sp and the precharge control signal P. When a level of either the sampling control signal Sp or the precharge control signal P is high, the switch E6 turns ON, so as to supply the data signal Vd to the source bus line Sb as an output SW1. When levels of the sampling control signal Sp and the precharge control signal P are low, the switch E6 turns OFF.

In this manner, open/close of the switch E6 is controlled on the basis of a logical sum of the precharge control signal P and the sampling control signal Sp. Further, open/close of the switch E12 is controlled on the basis of the sampling control signal Sp. Thus, when a level of the precharge control signal P is high, only the switch E6 opens. When a level of the sampling control signal Sp is high, both the switches E6 and E12 open. In this manner, the precharge and the sampling are different from each other in terms of a switch which turns ON/OFF. Further, the sampling circuit section 12 and the precharge circuit section 11 are connected in parallel to each other, and a voltage from the sampling circuit section 12 and a voltage from the precharge circuit section 11 are simultaneously supplied to the source bus line Sb in response to the sampling control signal Sp.

Figure 4:
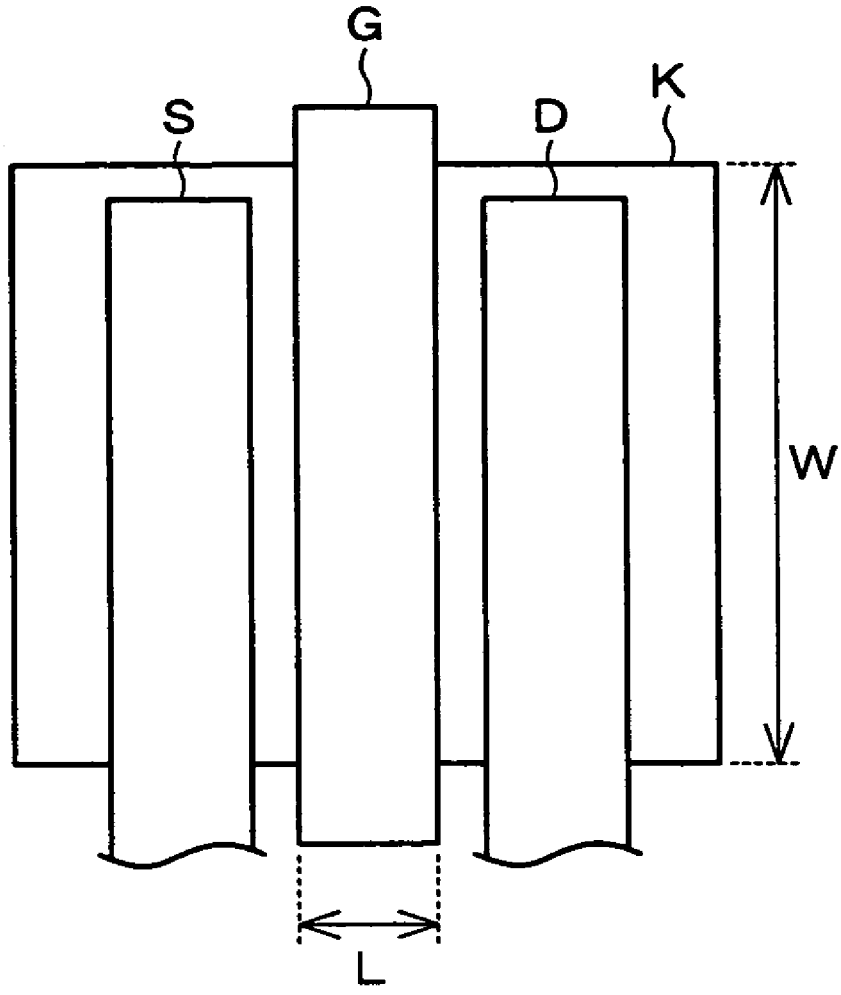
FIG. 4 is a plan view showing a part of an example of a semiconductor element included in the driving circuit.

Here, FIG. 4 shows a plan view of a part of an example of the semiconductor elements E1 to E12 of the present embodiment. Each of the semiconductor elements E1 to E12 is arranged so that: a source electrode S, a gate electrode G, and a drain electrode D are provided on a semiconductor layer k including a channel region, and a channel width is W and a channel length is L.

In the supply control circuit C of the present embodiment, channel widths W of the aforementioned semiconductor elements E1 to E12 are respectively set as follows. That is, E1 is 5 μm, E2 is 10 μm, E3 is 10 μm, E4 is 20 μm, E5 is 20 μm, E6 is 50 μm, E7 is 20 μm, E8 is 40 μm, E9 is 40 μm, E10 is 80 μm, E11 is 80 μm, and E12 is 200 μm. Note that, a precharge period in which the precharge operation is carried out is several μ seconds to 5μ seconds, and a sampling period in which the sampling operation is carried out is approximately 500 n seconds. However, the channel width W varies depending on a manufacturing process, a property and a performance of the semiconductor element. Further, the sampling period and the precharge period vary depending on a panel size, a driving condition, and the like. Thus, the aforementioned values are nothing but an example for describing the present embodiment.

Here, when the channel width W is wide, a resistance is small, which makes it possible to charge the device quickly. As a result, its driving ability is enhanced. That is, in the present embodiment, the channel width of the switch E6 of the precharge circuit section 11 is narrower than the channel width of the switch E12 of the sampling circuit section 12, and the resistance of the switch E6 is higher than the resistance of the switch E12. Further, the channel widths of the semiconductor elements E1 to E6 of the precharge circuit section 11 are narrower than the channel widths of the semiconductor elements E7 to E12 of the sampling circuit section 12, and the resistances of the semiconductor elements E1 to E6 are higher than the resistances of the semiconductor elements E7 to E12. In this manner, also in each of semiconductor elements other than the switches, a channel width W is determined in consideration for a gate load at the next stage, so that the channel width is determined so as to correspond to the channel width of the transistor of the switch. Therefore, a current generated in the precharge circuit section 11 is smaller than a current generated in the sampling circuit section 12.

Figure 6:
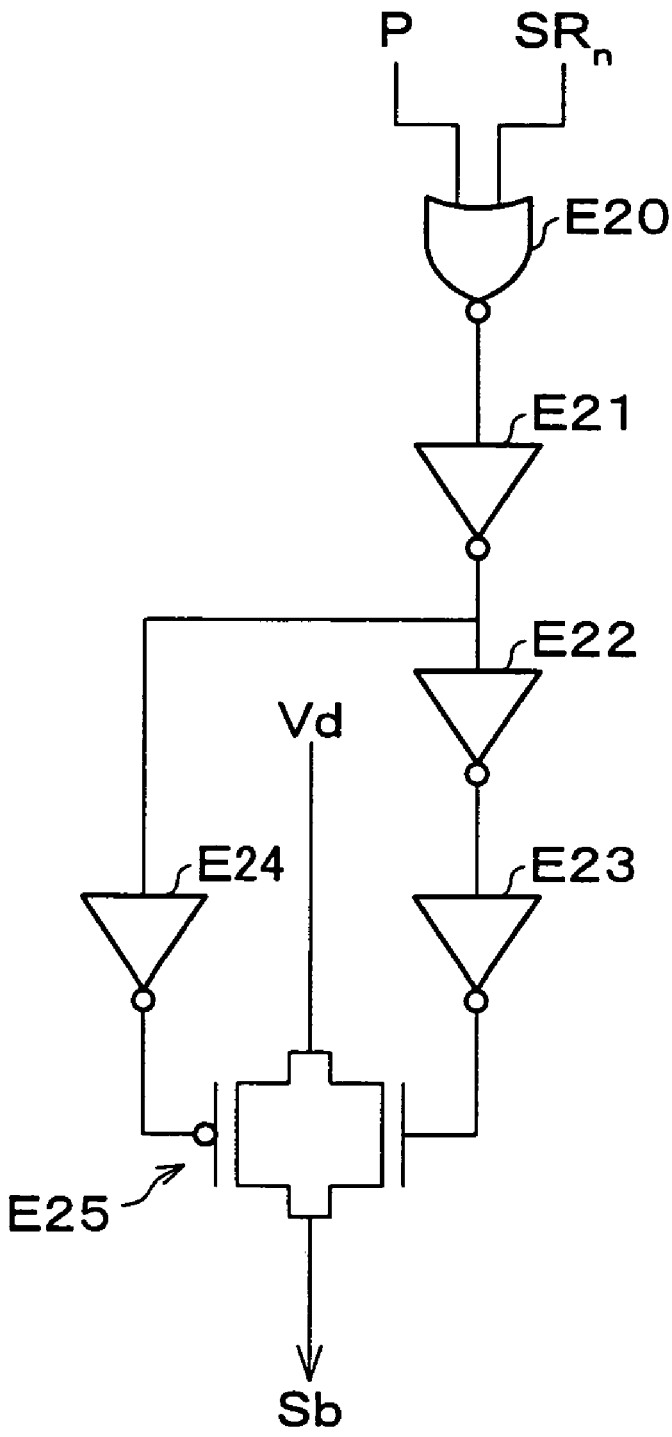
FIG. 6 is a logic circuit diagram showing a part of an example of a conventional display device driving circuit.

Note that, when the switches E6 and E12 turn ON so as to carry out the sampling operation, the supply control circuit C arranged in the foregoing manner can exhibit a current supplying ability substantially the same as that of a conventional supply control circuit, shown in FIG. 6, which is arranged so that: other conditions such as the channel width are the same as those of the supply control circuit C of FIG. 1 and channel widths of semiconductor elements E20 to E25 are so set that E20 is 25 μm, E21 is 50 μm, E22 is 50 μm, E23 is 100 μm, E24 is 100 μm, and E25 is 250 μm. Further, also the channel widths W of the aforementioned switches E20 to E25 are nothing but an example for describing the present embodiment as in the foregoing description.

Figure 5:
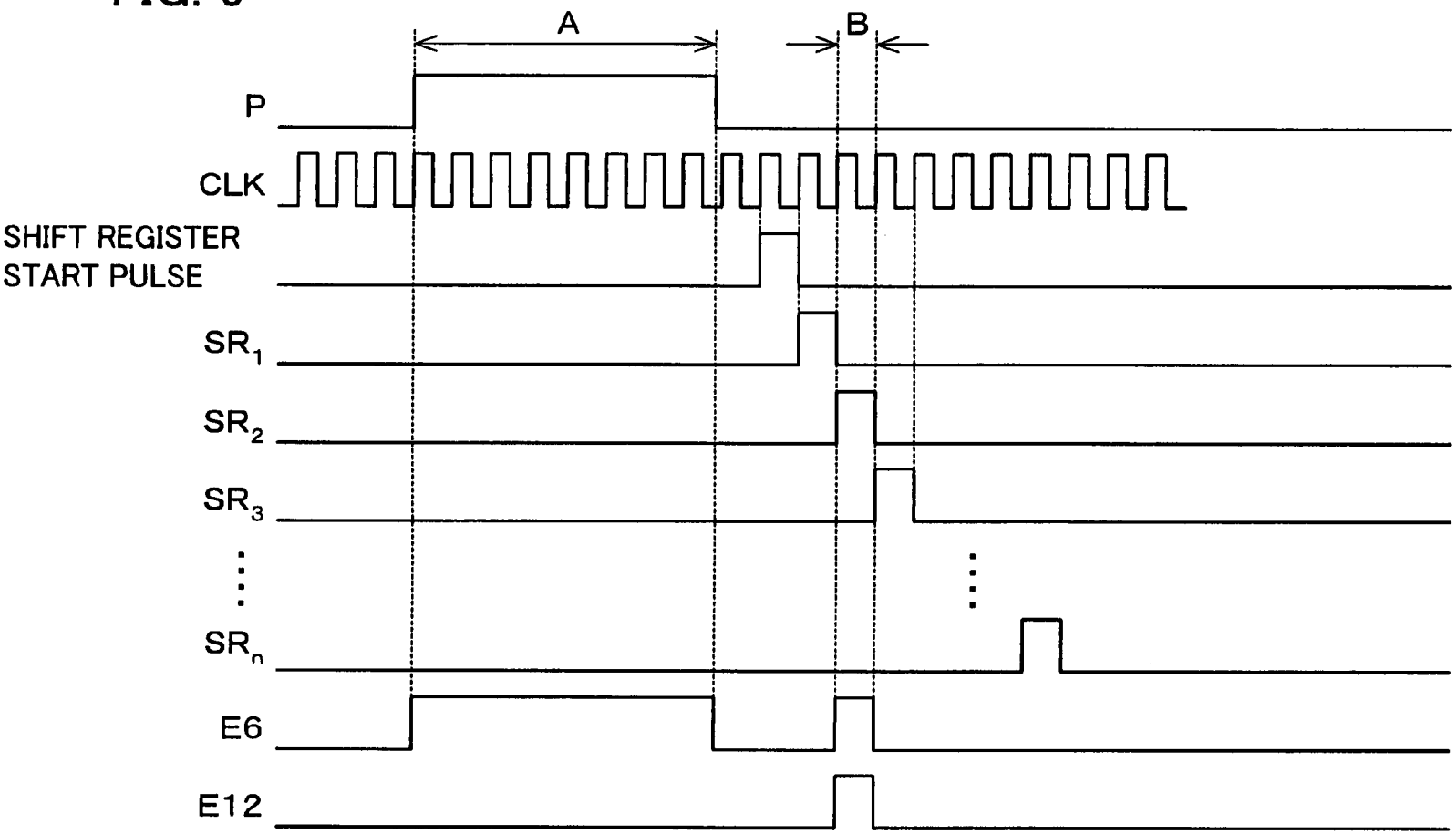
FIG. 5 is a timing chart indicative of input/output properties of the driving circuit.

Next, FIG. 5 shows a timing chart for describing an input/output operation performed in the supply control circuit C over one horizontal period. In FIG. 5, the data signal Vd is omitted so as to facilitate the description. In FIG. 5, a period indicated by "A" is a precharge period in which a level of the precharge control signal P is made high so as to carry out the precharge operation. In this case, the precharge period is a part of a horizontal retrace line period. Further, a period indicated by "B" is a writing period (sampling period) in which a video signal is written on the source bus line. In this manner, the precharge period (period A) is sufficiently longer than the sampling period (period B). Thus, when carrying out the precharge operation, even though the channel width of the precharge circuit section 11 is small, it is possible to sufficiently charge the source bus line Sb.

In the precharge period A, the precharge control signal P is made active (high) so as to carry out the precharge operation. Here, when the precharge control signal P is active, a potential of the precharge control signal P is a potential which causes the precharge circuit section 11 to be active, that is, a potential (active potential) which causes the precharge circuit section 11 to supply the data signal Vd to the source bus line Sb. The potential may be high or low. In the present embodiment, the potential is high. Since the precharge control signal P becomes high, only the switch E6 on the side of the precharge circuit section 11 turns ON in each supply control circuit C. The switch E12 on the side of the sampling circuit section 12 remains OFF. In this manner, the switch E12 on the side of the sampling circuit section 12 remains OFF, so that no current flows toward the sampling circuit section 12. Thus, it is possible to reduce the power consumption when carrying out the precharge operation.

Further, a shift register start pulse is inputted from the controller 5 to the shift register SR, and the clock CLK is inputted to each stage. Thus, the sampling control signals Sp (indicated by SR1 to SRn in the figure) are outputted to the supply control circuits C from the respective shift registers SR1 to SRn. In the writing period B, the switch E6 and the switch E12 of each supply control circuit turn ON in accordance with each of the sampling control signals Sp. Thus, the data signal Vd is written on the source bus line Sb, so that a potential is written on each pixel.

In this manner, a voltage is written on the pixels corresponding to the next gate bus line Gb at the next horizontal period, the writing is sequentially repeated, so as to display an image in the display section 2 of the liquid crystal display device 1.

As described above, the source driver 4 of the liquid crystal display device 1 causes the switch E12 on the side of the sampling circuit section 12 not to operate when carrying out the precharge operation, so that it is possible to suppress the power consumption. Moreover, the channel widths of the semiconductor elements E1 to E12 of the supply control circuit C are appropriately set as described above, so that it is possible to realize the same current supplying ability as that of the conventional device when carrying out the sampling operation.

Note that, the aforementioned conventional arrangement is made without recognizing the following condition: in case of using the simultaneous precharge system of dot-sequential driving, the writing time (time taken to carry out the writing operation) in the precharge operation and the writing time in the sampling operation are different from each other, so that the precharge operation and the sampling operation are different from each other in terms of a most appropriate writing ability in consideration for the power consumption. Particularly, the conventional arrangement pays no attention to the following condition: when the writing operation is carried out without any difference between the precharge operation and the sampling operation, a current excessively flows in carrying out the precharge operation, so that it is preferable to suppress the current supplying ability in carrying out the precharge operation.

Note that, the foregoing embodiment describes the liquid crystal display device 1 using the liquid crystal, but the present invention is not limited to this. The source driver 4 which functions as the driving circuit can be applied to a display device using an organic EL (Electro luminescence) plasma display for example.

Further, the foregoing embodiment describes the arrangement using the line inversion driving system as a driving system, but the present invention is not limited to this. For example, it is possible to use a dot inversion driving system, and it is needless to say that other driving system may be used.

Further, the aforementioned embodiment describes the arrangement using the dot-sequential driving system for every three lines of RGB (Red, Green, Blue) as a dot-sequential driving system, but the present invention is not limited to this. For example, the dot-sequential driving system may be for each line, or may be for every six lines (Rn, Gn, Bn, Rn+1, Gn+1, Bn+1) constituted of two RGB groups.

Further, in the aforementioned embodiment, a value of a voltage required in the simultaneous precharge is not particularly limited.

Further, the aforementioned embodiment describes the arrangement adjusting the channel width W so as to adjust the driving ability of the switch, but the present invention is not limited to this. For example, the channel length L may be used to adjust the driving ability. In this case, when the channel length L is short, the resistance is low, so that a larger amount of a current flows, which results in a higher driving ability. Further, it is possible to adjust the driving ability by changing a material for the semiconductor element.

Further, the aforementioned embodiment describes the arrangement in which the channel width of the semiconductor element other than the switches is made in proportion to the channel width of the transistor of the switch in the supply control circuit C, but the present invention is not limited to this. It is needless to say that not the channel width but the channel length may be adjusted. However, when the channel width of the semiconductor element other than the switches is made to be the same as a channel width of a semiconductor element, provided on a conventional supply control circuit, which corresponds to that semiconductor element, a current is not reduced, and the whole current supplying ability is higher than desired. Thus, it is preferable to optimize the channel width so as to correspond to the size of the switch as described above.

Further, the aforementioned embodiment describes the input/output property of the supply control circuit C with reference to FIG. 5, but the present invention is not limited to this. For example, the shift register SR may be a flip-flop type or may be a set/reset type as long as it is possible to obtain a waveform shown in FIG. 5. Further, waveforms of respective signals shown in FIG. 5 are nothing but an example, and can be varied within a scope of the present invention.

Further, the aforementioned embodiment describes the source driver 4, including the supply control circuit C, which is provided on one side of the display section 2. A driving circuit of a conventional display device includes a source driver positioned on one side of a display section, and includes a supply control circuit, used in precharge operation, which is positioned on the other side of the display section. The arrangement of the source driver 4 of the present invention enables its circuit size to be smaller than a circuit size of the conventional source driver. That is, mere addition of the precharge arrangement to the conventional arrangement results in a larger circuit size.

Further, the supply control circuit C of the aforementioned embodiment is divided into two sections such as the precharge circuit section 11 and the sampling circuit section 12 so as to correspond to respective functions. A total of the channel widths of the semiconductor elements of each of the circuit sections 11 and 12 of the supply control circuit C is equal to a channel width of a corresponding conventional supply control circuit having a desired current supplying ability. Thus, the circuit size is not largely increased with its increment corresponding to the number of wirings.

Further, the aforementioned embodiment describes the source driver using the simultaneous precharge system. Here, the arrangement recited in Tokukai 2000-206491 does not uses the simultaneous precharge system, so that the arrangement is different from the arrangement of the present invention. Further, the arrangement recited in Tokukai 2000-206491 results in higher cost.

Further, it is possible to express the display device driving circuit as a source bus line writing control circuit, disposed so as to correspond to each data line of the pixel section, which includes a precharge control timing signal, a sampling control timing signal, and a video line. Further, it is also possible to express the display device driving circuit as a driving circuit, including a precharge control switch and a sampling control switch, which supplies video line data to the source bus line while discriminating the precharge operation and the sampling operation from each other.

Embodiment 2

The following description will explain another embodiment of the present invention with reference to FIG. 7 to FIG. 10. Note that, for convenience in description, the same reference signs are given to members having the same functions as members shown in the Embodiment 1, and description thereof will be omitted.

A liquid crystal display device of the present embodiment is different from the liquid crystal display device of the Embodiment 1 in that: it is possible to carry out specific display in a part of a screen by using only the precharge circuit section. That is, the liquid crystal display device of the present embodiment can be switched between a normal display mode and a display mode in which specific display is carried out in a part of a screen and normal display is carried out in other area of the screen. Note that, the specific display is such display that display data of the pixels in a single horizontal line are identical with each other or such display that: display data of R are identical with each other, and/or display data of G are identical with each other, and/or display data of B are identical with each other, or display data of each of video signals supplied to the source bus line driving circuit are identical with each other.

A driving circuit of the present embodiment is different from the driving circuit of the Embodiment 1 in that the source bus line is charged by using only the precharge circuit section in case where the specific display is carried out in a part of a screen. Thus, it is possible to further reduce the power consumption.

Examples of the display mode include a wide display mode, a partial display mode, and the like.

Figure 7:
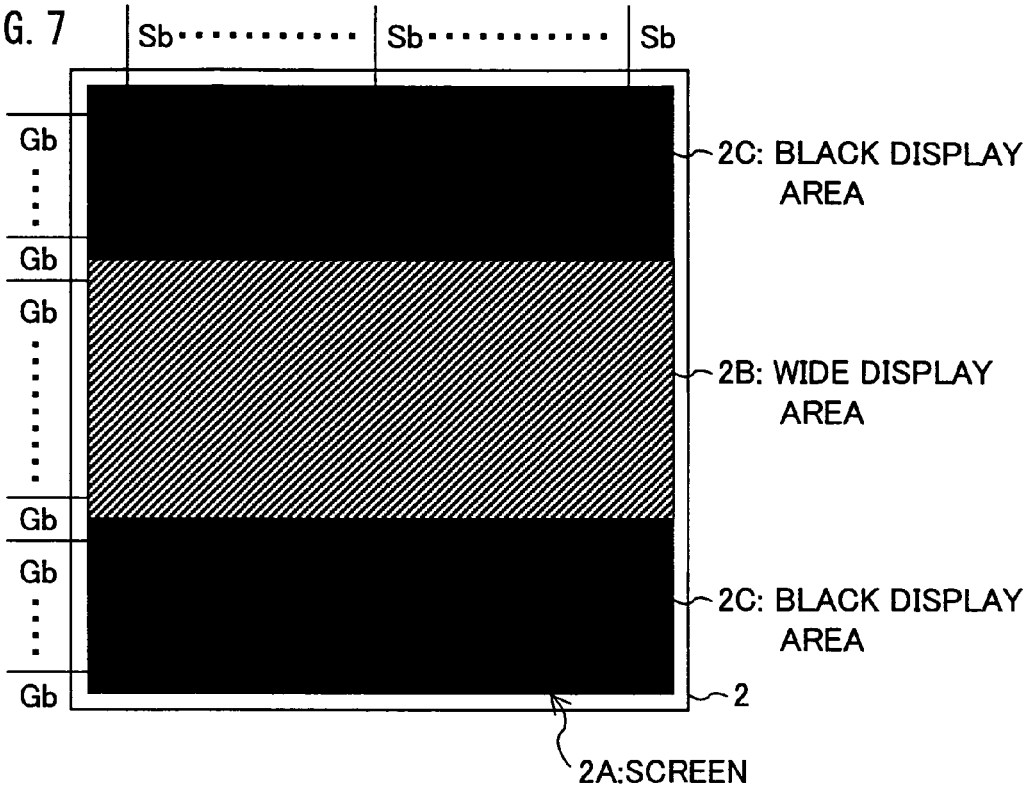
FIG. 7 is a plan view showing a display section in case of displaying a video in a wide display mode.

As shown in FIG. 7, the wide display mode is such that: in order to display an image whose aspect ratio is 16:9 by using a display section 2 whose aspect ratio is 4:3, black display is carried out in the whole upper end area and the whole lower end area (black display are 2C: black mask area) of a screen 2A in the display section 2, and video display of 16:9 is carried out in other area of the screen 2A (wide display area 2B). The black display area 2C is constituted of two blocks of the screen 2A in the display section 2.

Figure 8:
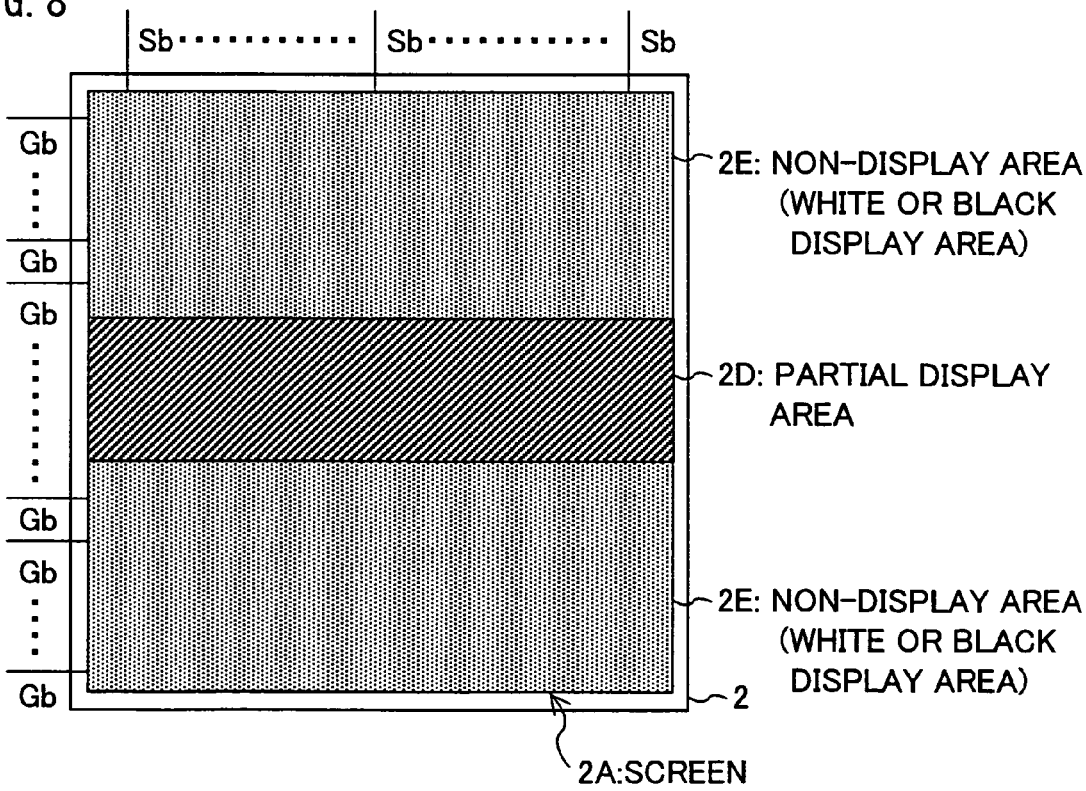
FIG. 8 is a plan view showing the display section in case of displaying a video in a partial display mode.

Further, as shown in FIG. 8, the partial display mode is such that: a video is displayed only in a part (partial display area 2D) of the screen 2A of the display section 2, and other area of the screen 2A is set as a non-display area 2E (white display area or black display area), thereby reducing the power consumption. The non-display area 2E is constituted of two blocks of the screen 2A in the display section 2.

In the non-display area at the time of the partial display mode, it is general that: a voltage for a normally side display (for example, white display in a normally-white-mode display portion, or black display in a normally-black-mode display portion) is supplied to the source bus line during a period in which the pixel transistor is in an ON state (selection period), so as to write the voltage on the pixels. In case of the normally white mode for example, a potential for the white display is written on the pixels in the non-display area. The writing operation is periodically performed in the non-display area. This is based on the following reason: in case where the pixel transistor is OFF for a long time, OFF leak of the transistor causes a potential of the source bus line to leak to a drain side portion of the pixel, so that a potential applied to liquid crystal gradually varies. Further, the normally side display voltage is applied since it is advantageous in terms of the power consumption.

In FIG. 8, both upper and lower end portions of the screen 2A correspond to the non-display areas 2E at the time of the partial display. However, the arrangement is not necessarily limited to the upper and lower end portions of the screen, but it may be so arranged that the non-display area corresponds to one block of the screen 2A of the display section 2. For example, the non-display section may be positioned in the upper end portion, or in the lower end portion, or in a center portion. Three blocks or more of the screen 2A of the display section 2 may be used as the non-display area. Further, in FIG. 8, the non-display area 2E is in a white display state or in a black display state. However, the non-display area 2E may be in other display state, such as a blue display state, a red display state, a green display state, a blue complementary color display state, a red complementary color display state, a green complementary color display state, a (achromatic color or chromatic color) halftone display state, and the like.

Next, arrangements of the display device and the driving circuit according to the present embodiment are described as follows. The following description will explain the case where the wide display mode or the partial display mode is adopted as the display mode. Further, the following description will also explain a case where the non-display area in the partial display mode is a white display area.

The display device and the driving circuit according to the present embodiment include, instead of the controller 5 of the Embodiment 1, a controller which can operate not only in the normal display mode but also in the wide display mode or in the partial display mode, and are arranged in the same manner as the liquid crystal display device 1 and the driving circuits (the source driver 4 and the controller 5).

The controller used in the present embodiment operates in the same manner as the controller 5 of the Embodiment 1 in the normal display mode. That is, ordinarily, in the normal display mode, the controller outputs the precharge control signal P which is high during a horizontal retrace line period and is low during other period. Further, the controller outputs a normal data signal Vd for video display in the normal display mode.

While, in the wide display mode, the controller outputs the precharge control signal P which is high during a horizontal retrace line period corresponding to the wide display area 2B and a black display period (horizontal period corresponding to the black display area 2C) and is low during other period. Further, in the wide display mode, the controller always outputs a data signal Vd for black display during a horizontal period corresponding to the black display area 2C, and outputs a normal data signal Vd for video display during a horizontal period corresponding to the wide display area 2B.

Further, in the partial display mode, the controller outputs the precharge control signal P during the horizontal retrace line period corresponding to the partial display area 2D and the non-display period (horizontal period corresponding to the non-display area 2E) and is low during other period. Further, in the partial display mode, the controller always outputs a data signal Vd (data signal Vd for white display) for normally side display during a horizontal period corresponding to the non-display area 2E, and outputs a normal data signal Vd for video display during a horizontal period corresponding to the partial display area 2D.

A supply control circuit C of the present embodiment is arranged basically in the same manner as the supply control circuit C of the Embodiment 1, but is arranged so that an input signal of the inverter E7 is always kept low at the time of the writing operation on the pixels in the black display area (2C) in the wide display mode or at the time of the writing operation on the pixels in the non-display area (2E) in the partial display mode.

Figure 9:
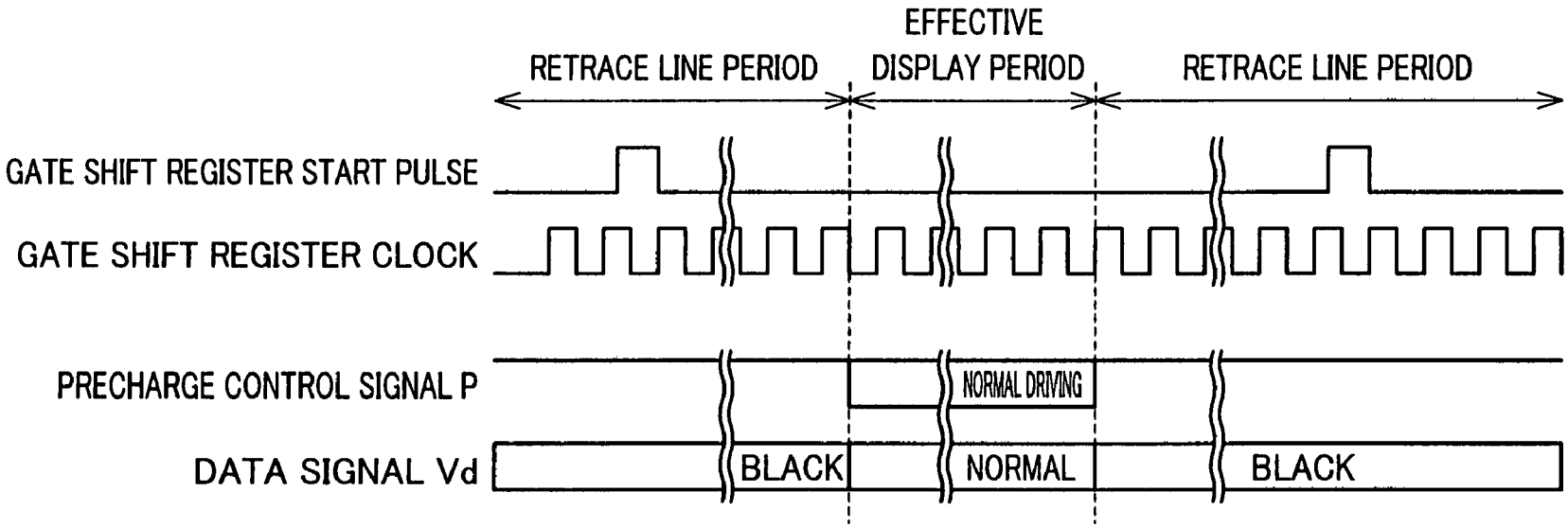
FIG. 9 is a waveform chart showing signals inputted to a gate driver and a source driver in case where a display device according to an embodiment of the present invention operates in the wide display mode.

FIG. 9 shows an example of a timing chart in the wide display. An effective display period is a period in which a video signal corresponding to the wide display area 2B is written on the corresponding area. Further, a gate shift register start pulse is a start pulse supplied from the controller to a shift register (not shown) in the gate driver 3. The video display (selection of the respective gate bus lines Gb) is commenced in synchronism with rise of the gate shift register start pulse. A gate shift register clock is a clock signal supplied from the controller to a shift register (not shown) in the gate driver 3. A timing at which the respective gate bus lines Gb are selected is controlled by the gate shift register clock.

As shown in FIG. 9, in the wide display mode, the precharge control signal P is high, in the wide display area 2B, during a part of the horizontal retrace line period, like the normal driving. Therefore, in each supply control circuit C, the switch E6 on the side of the precharge circuit section 11 turns ON, so that the precharge is carried out. While, an output signal of the shift register SR is always kept low during a horizontal period corresponding to the black display area 2C, so that the switch E12 on the side of the sampling circuit section 12 remains OFF. In this manner, the switch E12 on the side of the sampling circuit section 12 is OFF, so that no current flows toward the sampling circuit section 12. Thus, it is possible to reduce the power consumption in the precharge.

Note that, the normal driving of the precharge control signal is such that: the precharge control signal is high in the horizontal retrace line period or in a part of the horizontal retrace line period, so as to perform the precharge operation merely in the period.

Further, in the wide display mode, the precharge control signal P is high during a horizontal period corresponding to the black display area 2C. Therefore, in each supply control circuit C, the switch E6 on the side of the precharge circuit section 11 turns ON, so that writing operation on the black display area 2C is carried out. While, an input signal of the inverter E7 is always low during a horizontal period corresponding to the black display area 2C, so that the switch E12 on the side of the sampling circuit section 12 remains OFF. Therefore, only the precharge circuit section 11 is used for writing on the black display area 2C, so that it is possible to reduce the power consumption. Further, a time taken to write data on the black display area 2C corresponds to a single horizontal period, so that the time taken to write data on the black display area 2C is longer than the sampling period. Thus, it is possible to obtain a longer time taken to write data on the black display area 2C than that in a case where the sampling circuit section 12 is used to carry out the writing operation on the source bus line Sb (in a case where the switch E12 of the sampling circuit section 12 is turned ON and the switch E6 of the precharge circuit section 11 is turned ON so as to output a black display data signal Vd to the source bus line Sb). Thus, it is possible to sufficiently charge the source bus line Sb merely by an output signal from the switch E6 of the precharge circuit section 11.

Figure 10:
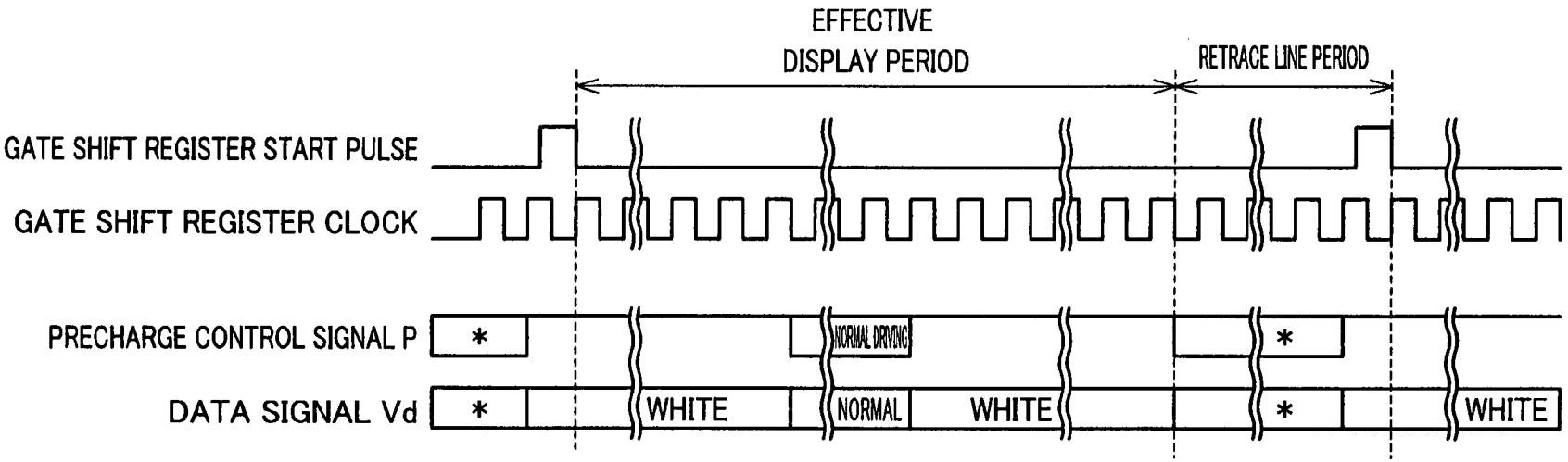
FIG. 10 is a waveform chart showing signals inputted to a gate driver and a source driver in case where a display device according to an embodiment of the present invention operates in the partial display mode.

FIG. 10 shows an example of a timing chart in the partial display.

As shown in FIG. 10, in the partial display mode, the precharge control signal P is high, in the partial display area 2D, during a part of the horizontal retrace line period, like the normal driving. Thus, in each supply control circuit C, the switch E6 on the side of the precharge circuit section 11 turns ON, so that the precharge is carried out. While, an output signal of the shift register SR is always low during a horizontal period corresponding to the non-display area 2E, so that the switch E12 on the side of the sampling circuit section 12 remains OFF. In this manner, the switch E12 on the side of the sampling circuit section 12 is OFF, so that no current flows toward the sampling circuit section 12. Thus, it is possible to reduce the power consumption in the precharge operation.

Further, in the partial display mode, the precharge control signal P is high during a horizontal period corresponding to the non-display area 2E. Thus, in each supply control circuit C, the switch E6 on the side of the precharge circuit section 11 turns ON, so that the writing operation on the non-display area 2E is carried out. While, an input signal of the inverter E7 is always low during a horizontal period corresponding to the non-display area 2E, so that the switch E12 on the side of the sampling circuit section 12 remains OFF. Thus, only the precharge circuit section 11 is used for the writing on the non-display area 2E, so that it is possible to reduce the power consumption. Further, a time taken to write data on the non-display area 2E corresponds to a single horizontal period, so that the time taken to write data on the non-display area 2E is longer than the sampling period. Thus, it is possible to obtain a longer time taken to write data on the non-display area 2E than that in a case where the sampling circuit section 12 is used for normal writing on the source bus line Sb (in a case where the switch E12 of the sampling circuit section 12 is turned ON and the switch E6 of the precharge circuit section 11 is turned ON so as to output a data signal Vd for black display to the source bus line Sb). Therefore, as in the precharge operation, it is possible to sufficiently charge the source bus line Sb merely by an output signal from the switch E6 of the precharge circuit section 11.

In the foregoing description, only the precharge circuit section 11 of the supply control circuit C is used for writing on the source bus line Sb in case of carrying out the white display or the black display in a part of the screen 2A of the display section 2. However, when the display data corresponding to the pixels in a single horizontal line are identical with each other in each data signal supplied, it is possible to carry out the same driving, so that it is possible to carry out display other than the white display and the black display in this area. For example, in case where data signals of R, G, and B are supplied to the source driver 4, it is possible to cause a corresponding area to display any one of red monochrome, blue monochrome, and green monochrome, or red complementary color, blue complementary color, and green complementary color. Further, it is possible to carry out halftone display thereof.

Embodiment 3

Each of the driving circuits in the aforementioned embodiments is arranged so that the precharge circuit section charges the source bus line Sb with a single switch E6. However, it may be so arranged that a plurality of precharge circuits are connected in parallel. In case where a plurality of precharge circuits are connected in parallel, it may be so arranged that: plural kinds of precharge control signals are inputted to the plural precharge circuits, and a current supplying ability which enables each of the precharge circuits to supply a current to the source bus line varies in response to the inputted precharge control signal.

As another embodiment of the present invention, an example of the driving circuit arranged in this manner is described as follows with reference to FIG. 11 to FIG. 13. Note that, for convenience in the description, the same reference signs are given to members having the same functions as members shown in the Embodiment 1 or 2, and description thereof is omitted.

The driving circuit according to the present embodiment is arranged in the same manner as the liquid crystal display device 1 and the driving circuits (source driver 4 and the controller 5) of the Embodiment 1 except that the driving circuit includes a supply control circuit C' instead of the supply control circuit C of the Embodiment 1 and includes a controller (not shown), having not only a function of the controller 5 but also a function for outputting a precharge control signal P2, instead of the controller 5.

Figure 11:
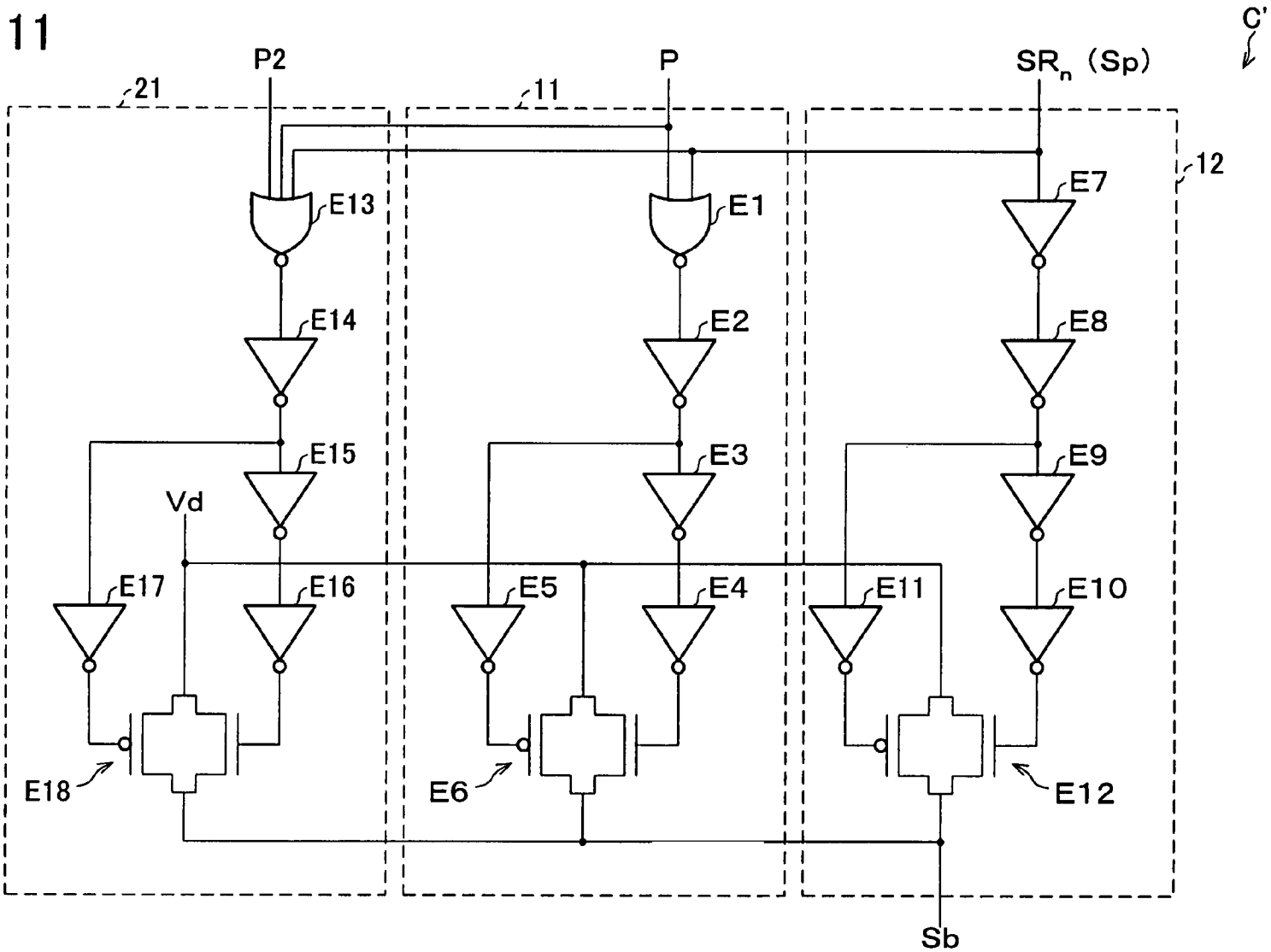
FIG. 11 is a circuit diagram showing a part of a display device driving circuit according to another embodiment of the present invention.

As shown in FIG. 11, the supply control circuit C' in this example is different from the supply control circuit C, having the precharge circuit section 11 constituted of the switch E6 and circuits (the NOR gate E1 and the inverters E2 to E5) controlling the switch E6, in that another precharge circuit section 21 constituted of a switch and circuits controlling the switch is added and these precharge circuit sections 11 and 21 are connected in parallel.

In the supply control circuit C', the number of the precharge circuit sections carrying out the precharge operation in the precharge period is varied, that is, the number of the switches supplying currents to the source bus lines Sb is varied, so as to change the driving ability of the precharge circuit section, that is, so as to change the currents (current supplying ability) supplied from the precharge circuit section to the source bus lines Sb at the time of the precharge operation.

The supply control circuit C' receives not only the precharge control signal P inputted to the supply control circuit C of FIG. 1 but also the precharge control signal P2. Further, the precharge circuit section of the supply control circuit C' is divided into two precharge circuit sections 11 and 21.

The precharge circuit section 21 includes a NOR gate E13, inverters E14 to E17, and a switch E18. Further, the precharge circuit 21 receives the precharge control signals P and P2 and the sampling control signal Sp so as to turn ON/OFF the switch E18 via the NOR gate E13 and the inverters E14 to E17. In the precharge circuit section 21, the switch E18 turns ON when any one of the sampling control signal Sp, the precharge control signal P, and the precharge control signal P2 is high, so that the data signal Vd is supplied to the source bus line Sb as an output.

The NOR gate E13 and the inverters E14 to 17 function as buffer circuits of the switch E18.

The precharge control signal P causes the switches E6 and E18 to turn ON/OFF. The supply control circuit C' receives the data signal Vd, and the switches E6 and E18 cause the data signal Vd to or not to be supplied to the source bus line Sb. Thus, in response to the precharge control signal P, the data signals Vd are caused to or not to be supplied from the two precharge circuit sections 11 and 21 to the source bus lines Sb. In more detail, when the precharge control signal P2 is active (high), the precharge circuit section 21 supplies the data signal Vd to the source bus line Sb.

Further, the precharge control signal P2 causes a single switch E18 to turn ON/OFF. Thus, the data signal Vd is caused to or not to be supplied from the precharge circuit section 21 to the source bus line Sb in response to the precharge control signal P2. In more detail, when the precharge control signal P2 is active (high), the precharge circuit section 21 supplies the data signal Vd to the source bus line Sb. At this time, the current supplying ability which enables the precharge circuit section (precharge circuit sections 11 and 21) to supply a current to the source bus line is smaller than that at the time when the precharge control signal P is active (high).

Further, in the controller of the driving circuit of the present embodiment, the precharge control signal P or the precharge control signal P2 is made active (high) during the precharge period. Thus, it is possible to selectively carry out (a) a precharge operation in which the precharge circuit sections 11 and 21 are used to supply a relatively large current and (b) a precharge operation in which the precharge circuit section 21 is used to supply a relatively small current, as a precharge operation carried out during the precharge period.

One of the precharge control signal P and the precharge control signal P2 is selected in accordance with a length of a usable period selected as a precharge period from a horizontal retrace line period determined in accordance with specifications of a driving condition corresponding to the display section 2 and specifications of a system provided with the display device. Then, a current supplying ability which enables a current to be supplied to the source bus line so as to carry out the precharge operation during the precharge period is selected. In case where the precharge period is long, the precharge operation is carried out by using the precharge control signal P2, so that it is possible to further reduce the power consumption. An advantage of this embodiment is such that: it is possible to change a driving condition without changing the design in accordance with user specifications, so that it is possible to minimize the power consumption.

Each of the switches E1 to E18 can be constituted of a transistor. Channel widths W of the transistors (E1 to E18) constituting the elements E1 to E18 can be set as follows: E1 is 5 μm, E2 is 5 μm, E3 is 5 μm, E4 is 10 μm, E5 is 10 μm, E6 is 25 μm, E7 is 20 μm, E8 is 40 μm, E9 is 40 μm, E10 is 80 μm, E11 is 80 μm, E12 is 200 μm, E13 is 5 μm, E14 is 5 μm, E15 is 5 μm, E16 is 10 μm, E17 is 10 μm, and E18 is 25 μm. Hereinafter, an arrangement set in this manner is referred to as "circuit example of FIG. 11".

In the setting example, a total size of the transistors is not so different from that of the supply control circuit C, shown in FIG. 1, in which the channel widths W of the semiconductor elements E1 to E12 are set as follows: E1 is 5 μm, E2 is 10 μm, E3 is 10 μm, E4 is 20 μm, E5 is 20 μm, E6 is 50 μm, E7 is 20 μm, E8 is 40 μm, E9 is 40 μm, E10 is 80 μm, E11 is 80 μm, and E12 is 200 μm (hereinafter, this setting is referred to as "circuit example of FIG. 1"). Thus, current consumption at the time when the precharge operation is carried out in accordance with the precharge control signal and the sampling operation is carried out in accordance with the sampling control signal Sp is not so different from that of the supply control circuit C of FIG. 1. However, the precharge operation is carried out by the precharge control signal P2, and the sampling operation is carried out by the sampling control signal Sp, so that it is possible to reduce the current consumption compared with the supply control circuit C shown in FIG. 1.

Figure 12:
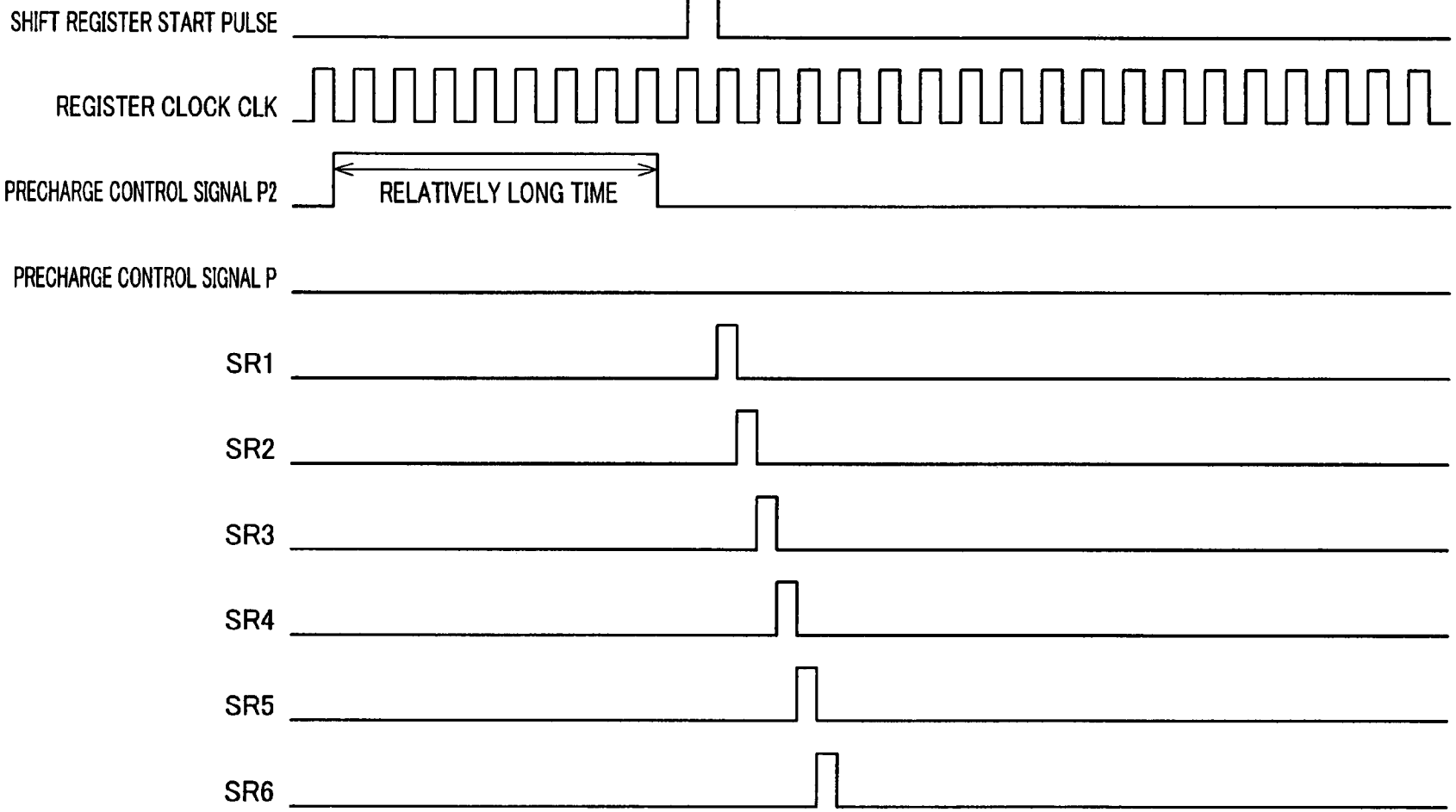
FIG. 12 is a waveform chart showing signals inputted to a source driver in case where a precharge period is set to be relatively large in a display device driving circuit according to still another embodiment of the present invention.
Figure 13:
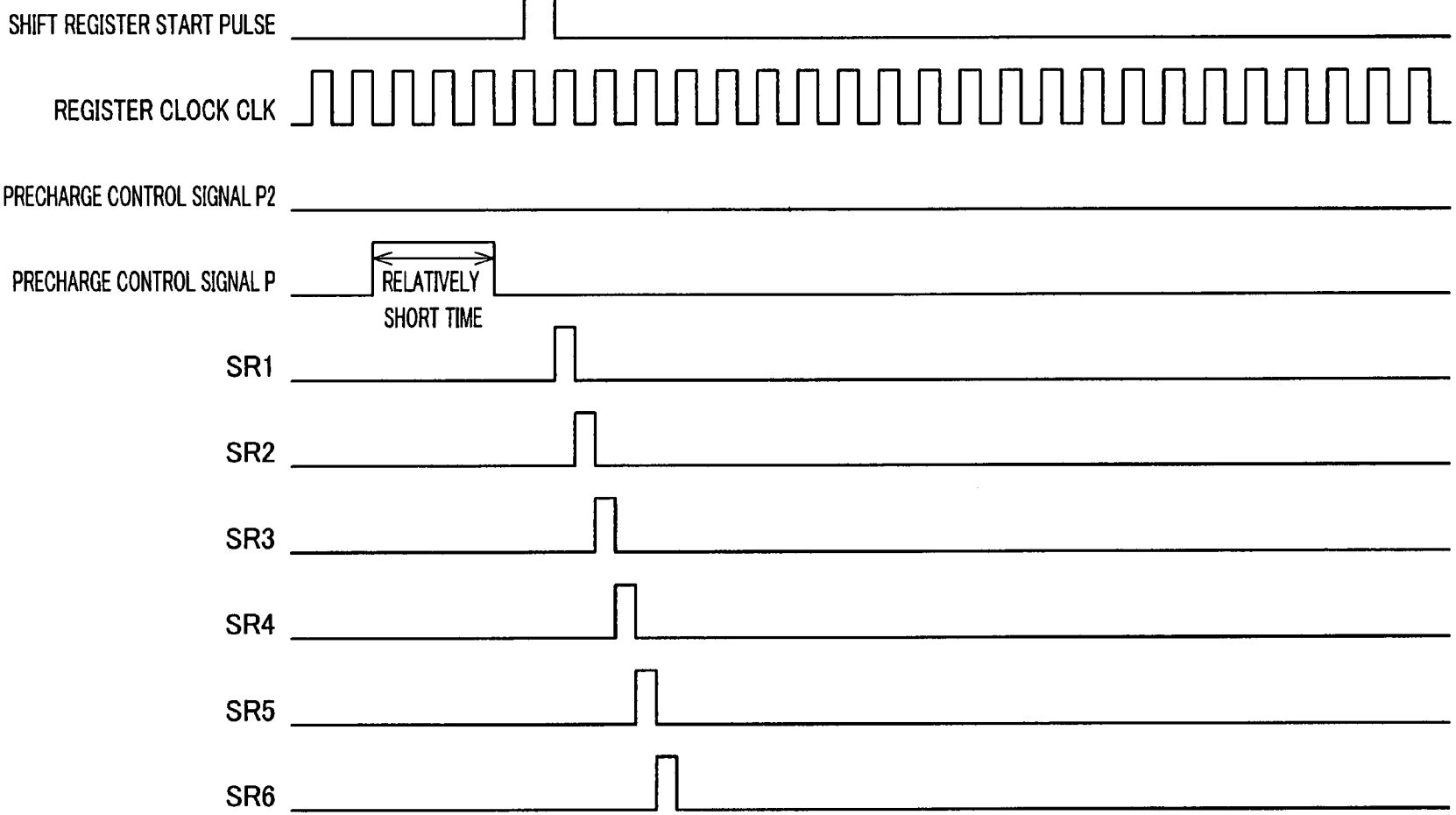
FIG. 13 is a waveform chart showing signals inputted to a source driver in case where a precharge period is set to be relatively large in a display device driving circuit according to further another embodiment of the present invention.

FIG. 12 and FIG. 13 show timing charts each of which illustrates how the circuit operates.

As shown in FIG. 12 and FIG. 13, either the precharge signal P or the precharge signal P2 selectively has an active potential which causes the precharge circuit sections (11•21) to supply the data signal Vd during a precharge period.

In case where it is possible to obtain a relatively long precharge time other than the sampling period due to the driving condition corresponding to the display section 2, for example, due to the timing of the driving, the precharge control signal P2 having an active potential for a relatively long time causes the precharge operation to be carried out as shown in FIG. 12. In the supply control circuit C' shown in FIG. 11, when the precharge control signal P2 is high (active potential) during a precharge period, the switches E6 and E12 are not conductive, and only the switch E18 is conductive, so as to carry out the writing operation on the source bus line Sb (the data signal Vd is supplied).

Further, in case where the precharge time is set to be the same as that of the circuit example of FIG. 1, as shown in the timing chart of FIG. 13, the precharge control signal P which has an active potential in a relatively short time causes the precharge to be carried out. When the precharge control signal P is high (active potential) in the precharge period, the switch E12 is not conductive, and the switches E6 and E18 are conductive, so as to carry out the writing operation on the source bus line Sb (precharge: the data signal Vd is supplied).

In this manner, by changing the number of switches to be opened during the precharge period in accordance with the precharge time, it is possible to adjust the current supplying ability of the precharge circuit section. As a result, it is possible to reduce a current flowing to the precharge circuit section during the precharge period, thereby suppressing the power consumption.

Note that, the circuit example of FIG. 11 is a nothing but an example based on the circuit example of FIG. 1, so that it is possible to vary the circuit arrangement, the transistor size, and the like as required.

Further, the aforementioned embodiment describes the example where the precharge control circuit section is arranged so that (a) the switch controlling a condition under which the source bus line is charged and (b) the two circuits controlling the switch are connected in parallel, but the present invention is not limited to the embodiment. For example, the precharge control circuit section may be arranged so that: (a) a switch controlling a condition under which the source bus line is charged and (b) three or more circuits (3, 4, 5, . . . ) controlling the switch are connected in parallel.

It is also possible to describe the present invention as follows.

(A) A display device driving circuit includes supply control circuits, supplying voltages to source bus lines connected to pixels of a display device, each of which is provided on each of the source bus lines, and each of the supply control circuits includes: a sampling circuit section for supplying a voltage to the source bus line in response to a sampling control signal for writing data of the pixels on the source bus line; and a precharge circuit section for supplying a voltage to the source bus line in response to the sampling control signal and for supplying the voltage to the source bus line in response to a precharge control signal for precharging the source bus line, wherein the precharge circuit section is constituted of a plurality of precharge circuits connected in parallel and has a precharge control signal for adjusting a precharging ability so as to adjust the precharging ability in accordance with the control signal.

According to the arrangement (A), it is so arranged that a plurality of precharge circuits are provided on each source bus line so as to adjust the precharging ability in accordance with a driving condition of the panel, thereby further reducing the power consumption.

(B) A display device includes the display device driving circuit arranged as described in (A).

(C) A display device driving circuit includes supply control circuits, supplying voltages to source bus lines connected to pixels of a display device, each of which is provided on each of the source bus lines, and each of the supply control circuits includes: a sampling circuit section for supplying a voltage to the source bus line in response to a sampling control signal for writing data of the pixels on the source bus line; and a precharge circuit section for supplying a voltage to the source bus line in response to the sampling control signal and for supplying the voltage to the source bus line in response to a precharge control signal for precharging the source bus line, wherein only the precharge circuit is used to display an image in the display device in case where display data corresponding to the pixels in a horizontal line of the display device are identical with each other, or display data of R are identical with each other, and/or display data of G are identical with each other, and/or display data of B are identical with each other, or display data of each of video signals (data signals) supplied are identical with each other.

According to the arrangement (C), the display data on a horizontal line of the display device is identical, or display data are identical in R, display data are identical in G, and display data are identical in B. Thus, even when the sampling circuit section is not used to carry out the writing operation on the source bus line, it is possible to reduce the power consumption in the sampling circuit section by using only the precharge circuit section to write the data, thereby further reducing the power consumption.

(D) The display device driving circuit described in (C) is arranged so that an area which displays an image by using only the precharge circuit section corresponds to a block or each of plural blocks.

An area which displays an image by using only the precharge circuit section corresponds to a block or each of plural blocks, so that it is possible to further reduce the power consumption. Note that, for example, it is possible to apply this driving operation to a non-display area of a partial driving operation, or it is possible to apply this driving operation to an upper-lower black mask area using a panel whose aspect ratio is 4:3 so as to display an image whose aspect ratio is 16:9.

(E) The display device driving circuit described in (C) or (D) is arranged so that the display data are black display data or white display data.

(F) The display device driving circuit described in (C) or (D) is arranged so that the display data are red monochrome display data, blue monochrome display data, or green monochrome display data, or complementary color display data thereof.

(G) The display device driving circuit described in (E) or (F) is arranged so that the display data are halftone display data.

According to the arrangements (E) to (G), the area which displays an image by using only the precharge circuit section may be black, white, red, green, or blue monochrome, or black, white, red, green, or blue complementary color, or halftone. As long as the display is such that the writing operation is possible by using only the precharge circuit, there is no particular limitation in use and it is possible to reduce the power consumption.

(H) A display device includes the display device driving circuit described in any one of (D) to (G).

The present invention is not limited to the aforementioned embodiments, and various modifications thereof are possible. Also, an embodiment obtained by properly combining technical means disclosed in the different embodiments with each other is included in the technical scope of the present invention.

The present invention is not limited to the aforementioned embodiments, and may be varied in many ways within a scope of the following claims. Embodiments obtained by combining technical means disclosed in different embodiments as required are included in the technical scope of the invention.

As described above, the display device driving circuit according to the present invention includes supply control circuits each of which supplies a voltage to each of source bus lines connected to pixels of a display device, wherein each of the supply control circuits includes: a sampling circuit section for supplying the voltage to the source bus line in response to a sampling control signal for writing data of the pixels on the source bus line; and a precharge circuit section for supplying the voltage to the source bus line in response to the sampling control signal and for supplying the voltage to the source bus line in response to one or more precharge control signals for precharging the source bus line.

Further, in addition to the foregoing arrangement, the display device driving circuit according to the present invention is arranged so that: the sampling circuit section has a first switch, causing the voltage to or not to be supplied to the source bus line, which turns ON/OFF in response to the sampling control signal, and the precharging circuit section has a second switch, causing the voltage to or not to be supplied to the source bus line, which turns ON/OFF in response to the sampling control signal and turns ON/OFF in response to each of the precharge control signals, the second switch being different from the first switch.

In this manner, it may be so arranged that the supply control circuit uses a switch so as to control a condition under which a voltage is supplied. According to the arrangement, the sampling circuit section includes a single switch and the precharge circuit section includes a single switch, and the number of the switches is small, so that it is possible to make the circuit size smaller.

Further, in addition to the arrangement, the display device driving circuit according to the present invention is arranged so that: the sampling circuit section and the precharge circuit section are connected in parallel to each other, and the sampling circuit section and the precharge circuit section simultaneously supply the voltage to the source bus line in response to the sampling control signal.

In this manner, it may be so arranged that the sampling circuit section and the precharge circuit section are connected in parallel. Thus, it is possible to realize the driving circuit most easily.

Here, in case of causing the switches to or not to supply a voltage in each circuit section, the switches in each circuit section are connected in parallel to each other. In case of forming the switch by using a semiconductor element including a semiconductor such as silicon, a resistance of the switch depends on a channel width and a channel length of the transistor for example. When the resistance of each semiconductor element is adjusted by using the channel width of the transistor, it is easy to design the channel width for obtaining a desired resistance and a desired writing ability. That is, the resistance is in proportion to an inverse number of the channel width, and a combined resistance in case where resistors are connected in parallel corresponds to an inverse number of a total of inverse numbers. Thus, in case of obtaining a combined resistance corresponding to a desired channel width for example, channel widths of the respective semiconductor elements are designed so that a total of the channel widths corresponds to the desired channel width. Note that, the design for obtaining the desired resistance is not limited to this. It is needless to say that the channel length may be used or other factors such as variation of materials may be adopted.

Further, in addition to the arrangement, the display device driving circuit according to the present invention is arranged so that: the supply control circuits of a first block are identical with each other in terms of the precharge control signal inputted to the supply control circuits connected to the source bus lines respectively, and second blocks, each of which includes one or more supply control circuits fewer than the supply control circuits of the first block, are different from each other in terms of the sampling control signal.

Here, let us consider a case where the source bus lines are not precharged line by line but a plurality of the source bus lines are simultaneously precharged. When the simultaneous writing operation is carried out, it is possible to obtain a longer writing period for precharge operation than a writing period for sampling operation.

Thus, in the precharge operation whose writing period is long, it is possible to drop the current supplying ability which enables the current to be supplied to the source bus line and it is possible to reduce a current flowing in peripheral circuits, thereby surely reducing the power consumption.

Further, in the foregoing arrangement, the precharge control signal may be a signal which is active during each horizontal retrace line period and is active before the sampling period. In this manner, when the precharge operation is carried out before the sampling period, it is possible to ensure the writing operation in the sampling.

Further, in addition to the foregoing arrangement, the display device driving circuit according to the present invention is arranged so that a current supplying ability which enables a current to be supplied to the source bus line via the precharge circuit section is lower than a current supplying ability which enables the current to be supplied to the source bus line via the sampling circuit section.

In this manner, the current supplying ability which enables a current to be supplied via the precharge circuit section, that is, a driving ability may be made smaller than a driving ability which enables a driving operation via the sampling circuit section.

Here, in case of carrying out the simultaneous precharge operation as described above, ordinarily, it is possible to obtain a relatively large time in the precharge, so that it is possible to slowly carry out the charging operation regardless of the panel size. That is, the current supplying ability in the precharge is not so required.

When a current occurring in the precharge circuit section is made smaller than a current occurring in the sampling circuit section like the foregoing arrangement, only the precharge circuit section is made to operate and the sampling circuit section is not made to operate in the precharge, so that it is possible to surely reduce the power consumption.

Note that, it is possible to adjust the current supplying ability by utilizing the switch size (a channel width or a channel length of a semiconductor element which functions as the switch). That is, in the foregoing circuit, the switch size (channel width) of the precharge circuit section may be made sufficiently smaller than that of the switch of the sampling circuit section.

Further, in addition to the foregoing arrangement, the display device driving circuit according to the present invention is arranged so that the precharge circuit section is constituted of a plurality of precharge circuits connected in parallel, and the precharge circuit section receives plural kinds of the precharge control signals so as to adjust a current supplying ability, which enables the precharge circuit section to supply a current to the source bus line, and each of the precharge circuits adjusts a current supplying ability, which enables the precharge circuit to supply a current, in accordance with the precharge control signal that has been received.

According to the arrangement, a plurality of precharge circuits connected in parallel are provided so as to correspond to each source bus line, and plural kinds of precharge control signal are inputted to the precharge circuits, and the precharge circuits adjust a current supplying ability, which enables a current to be supplied to the source bus line, in accordance with the precharge control signal that has been inputted. Thus, it is possible to adjust a current supplying ability, which enables the precharge circuit section to supply a current to the source bus line, by changing the precharge control signal. Therefore, it is possible to further reduce the power consumption by adjusting the current supplying ability, which enables the precharge circuit section to supply a current to the source bus line, in accordance with the driving condition of the display device.

Further, in addition to the foregoing arrangement, the display device driving circuit according to the present invention is arranged so that: the voltage is supplied to each of the source bus lines by using the precharge circuit section, without using the sampling circuit section to supply the voltage, so as to display an image in the pixels in a single horizontal line, in case where display data corresponding to the pixels in the single horizontal line of the display device are identical with each other.

According to the arrangement, in case where the display data corresponding to the pixels in a horizontal line of the display device are identical with each other, the precharge circuit section is used without using the sampling circuit section so as to simultaneously supply the voltage to the plural pixels, thereby displaying an image corresponding to the display data of the pixels in a horizontal line. Further, a voltage is supplied to the source bus line by using the precharge circuit section, so that it is possible to supply a voltage to the source bus line for a long time such as a single horizontal period compared with a case where a voltage is supplied to the source bus line by using the sampling circuit section. As a result, it is possible to realize preferable display by sufficiently charging the source bus line.

Further, according to the arrangement, only the precharge circuit is used, so that it is possible to obtain a longer writing time than a time in which an ordinary writing operation is carried out with respect to the source bus lines by using the sampling circuit. Thus, it is possible to sufficiently charge the source bus lines by using only the precharge circuit section. As a result, it is possible to reduce the power consumption in the sampling circuit section, thereby further reducing the power consumption of the device.

Further, in addition to the foregoing arrangement, the display device driving circuit according to the present invention is arranged so that: the voltage is supplied to each of the source bus lines by using the precharge circuit section, without using the sampling circuit section to supply the voltage, so as to display an image in the pixels in a single horizontal line, in case where display data corresponding to the pixels in a horizontal line of R are identical with each other, and/or display data corresponding to the pixels in a horizontal line of G are identical with each other, and/or display data corresponding to the pixels in a horizontal line of B are identical with each other, or display data corresponding to the pixels in a horizontal line corresponding to each of a plurality of video signals supplied to the source bus line driving circuit are identical with each other.

According to the arrangement, the precharge circuit section is used to simultaneously supply the voltage to the pixels, without using the sampling circuit section, in case where display data corresponding to the pixels in a horizontal line of R are identical with each other, and/or display data corresponding to the pixels in a horizontal line of G are identical with each other, and/or display data corresponding to the pixels in a horizontal line of B are identical with each other, or display data corresponding to the pixels in a horizontal line corresponding to each of a plurality of video signals supplied to the source bus line driving circuit are identical with each other. By performing this operation, display is carried out in the pixels in the single horizontal line. Thus, it is possible to reduce the power consumption of the sampling circuit section. Further, it is possible to further reduce the power consumption by applying this arrangement to the case where display data corresponding to the pixels in a horizontal line of R are identical with each other, and/or display data corresponding to the pixels in a horizontal line of G are identical with each other, and/or display data corresponding to the pixels in a horizontal line of B are identical with each other, or display data corresponding to the pixels in a horizontal line corresponding to each of a plurality of video signals supplied to the source bus line driving circuit are identical with each other.

Further, in addition to the foregoing arrangement, the display device driving circuit according to the present invention is arranged so that an area of the pixels in which an image is displayed by using the precharge circuit section without using the sampling circuit section corresponds to a block or each of plural blocks in a screen of the display device.

According to the arrangement, an area of pixels in which an image is displayed by using the precharge circuit section without using the sampling circuit section corresponds to a block or each of plural blocks of a screen of the display device, so that it is possible to further reduce the power consumption in the sampling circuit section. Thus, it is possible to further reduce the power consumption of the device.

The technique in which the precharge circuit section is used without using the sampling circuit section so as to display an image is applicable to a non-display area of a partial driving operation, or to an upper-lower black mask area using a panel whose aspect ratio is 4:3 so as to display an image whose aspect ratio is 16:9.

Further, in addition to the foregoing arrangement, the display device driving circuit according to the present invention is arranged so that the display data are black display data or white display data.

According to the arrangement, it is possible to make black display or white display in an area in which an image is displayed by using the precharge circuit section without using the sampling circuit section. Thus, it is possible to apply this arrangement to an upper-lower black mask area in case of displaying an image whose aspect ratio is 16:9 by using a display device whose aspect ratio is 4:3, and it is possible to reduce the power consumption.

Further, in addition to the foregoing arrangement, the display device driving circuit according to the present invention is arranged so that the display data are any one of red monochrome display data, blue monochrome display data, and green monochrome display data, or red complementary color display data, blue complementary color display data, and green complementary color display data.

According to the arrangement, it is possible to display any one of red monochrome, blue monochrome, green monochrome, red complementary color (cyan), blue complementary color (yellow), and green complementary color (magenta) by using the precharge circuit section without using the sampling circuit section. Thus, it is possible to make color display in a part of a screen of the display device, and it is possible to reduce the power consumption.

Further, in addition to the foregoing arrangement, the display device driving circuit according to the present invention is arranged so that the display data are halftone display data.

According to the arrangement, it is also possible to make halftone display in an area in which an image is displayed by using the precharge circuit section without using the sampling circuit section. Thus, it is possible to make the halftone display in a part of the screen of the display device, and it is possible to reduce the power consumption.

The display device driving circuit according to the present invention can reduce the power consumption, so that the display device driving circuit is applicable as a portable display device driving circuit.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device driving circuit, comprising supply control circuits each of which supplies a precharge voltage for precharging and a video signal voltage corresponding to an inputted video signal to each of source bus lines connected to pixels of a display device, wherein each of the supply control circuits includes: a sampling circuit section for supplying the video signal voltage to the source bus line in response to a sampling control signal for writing data of the pixels on the source bus line; and a precharge circuit section for supplying the video signal voltage and the precharge voltage to the source bus line via at least a switch that is controlled by the sampling control signal and one or more precharge control signals for precharging the source bus line, wherein the sampling circuit section and the precharge circuit section simultaneously supply the video signal voltage to the source bus line in response to the sampling control signal.

2. The display device driving circuit as set forth in claim 1, wherein:

the sampling circuit section has a first switch, causing the video signal voltage to or not to be supplied to the source bus line, which turns ON/OFF in response to the sampling control signal, and the precharging circuit section has a second switch, causing the video signal voltage and the precharge voltage to or not to be supplied to the source bus line, which turns ON/OFF in response to the sampling control signal and turns ON/OFF in response to each of the precharge control signals, the second switch being different from the first switch.

3. The display device driving circuit as set forth in claim 2, wherein:

the sampling circuit section further includes a first buffer circuit for supplying the sampling control signal to a control terminal of the first switch, and the precharge circuit section further includes a second buffer circuit for supplying the sampling control signal to a control terminal of the second switch.

4. The display device driving circuit as set forth in claim 1, wherein:

the sampling circuit section and the precharge circuit section are connected in parallel to each other, and the sampling circuit section and the precharge circuit section simultaneously supply the video signal voltage to the source bus line in response to the sampling control signal.

5. The display device driving circuit as set forth in claim 1, wherein:

the supply control circuits of a first block are identical with each other in terms of the precharge control signal inputted to the supply control circuits connected to the source bus lines respectively, and second blocks, each of which includes one or more supply control circuits fewer than the supply control circuits of the first block, are different from each other in terms of the sampling control signal.

6. The display device driving circuit as set forth in claim 1, wherein a current supplying ability which enables a current to be supplied to the source bus line via the precharge circuit section is lower than a current supplying ability which enables the current to be supplied to the source bus line via the sampling circuit section.

7. The display device driving circuit as set forth in claim 1, wherein:

the sampling circuit section and the precharge circuit section are connected in parallel to each other, and the video signal voltage is not supplied from the sampling circuit section and the video signal voltage and the precharge voltage is supplied from the precharge circuit section to the source bus line during at least one part of a horizontal retrace line period.

8. The display device driving circuit as set forth in claim 1, wherein the precharge circuit section is constituted of a plurality of precharge circuits connected in parallel, and the precharge circuit section receives plural kinds of the precharge control signals so as to adjust a current supplying ability, which enables the precharge circuit section to supply a current to the source bus line, and each of the precharge circuits adjusts a current supplying ability, which enables the precharge circuit to supply a current, in accordance with the precharge control signal that has been received.

9. A display device driving circuit, comprising supply control circuits each of which supplies a precharge voltage for precharging and a video signal voltage corresponding to an inputted video signal to each of source bus lines connected to pixels of a display device, wherein each of the supply control circuits includes:

a sampling circuit section for supplying the video signal voltage to the source bus line in response to a sampling control signal for writing data of the pixels on the source bus line;

a precharge circuit section for supplying the video signal voltage and the precharge voltage to the source bus line via at least a switch that is controlled by the sampling control signal and one or more precharge control signals for precharging the source bus line, wherein the precharge circuit section is constituted of a plurality of precharge circuits connected in parallel, and the precharge circuit section receives plural kinds of the precharge control signals so as to adjust a current supplying ability, which enables the precharge circuit section to supply a current to the source bus line, and each of the precharge circuits adjusts a current supplying ability, which enables the precharge circuit to supply a current, in accordance with the precharge control signal that has been received, and wherein:

the plural kinds of the precharge control signals include a first precharge control signal and a second precharge control signal, and either the first precharge control signal or the second precharge control signal selectively has an active potential which causes the precharge circuit section to supply the video signal voltage, and a number of the precharge circuits receiving the first precharge control signal is larger than a number of the precharge circuits receiving the second precharge control signal.

10. The display device driving circuit as set forth in claim 9, wherein:

each of the first precharge control signal and the second precharge control signal has the active potential during at least a part of a horizontal retrace line period, and a time in which the second precharge control signal has the active potential during said at least a part of the horizontal retrace line period is longer than a time in which the first precharge control signal has the active potential during said at least a part of the horizontal retrace line period.

11. The display device driving circuit as set forth in claim 1, wherein the video signal voltage is supplied to each of the source bus lines by using the precharge circuit section, without using the sampling circuit section to supply the voltage, so as to display an image in the pixels in a single horizontal line, in case where display data corresponding to the pixels in the single horizontal line of the display device are identical with each other.

12. The display device driving circuit as set forth in claim 1, wherein the video signal voltage is supplied to each of the source bus lines by using the precharge circuit section, without using the sampling circuit section to supply the voltage, so as to display an image in the pixels in a single horizontal line, in case where display data corresponding to the pixels in a horizontal line of R are identical with each other, and/or display data corresponding to the pixels in a horizontal line of G are identical with each other, and/or display data corresponding to the pixels in a horizontal line of B are identical with each other, or display data corresponding to the pixels in a horizontal line corresponding to each of a plurality of video signals supplied to the source bus line driving circuit are identical with each other.

13. The display device driving circuit as set forth in claim 11, wherein an area of the pixels in which an image is displayed by using the precharge circuit section without using the sampling circuit section corresponds to a block or each of plural blocks in a screen of the display device.

14. The display device driving circuit as set forth in claim 12, wherein an area of the pixels in which an image is displayed by using the precharge circuit section without using the sampling circuit section corresponds to a block or each of plural blocks in a screen of the display device.

15. The display device driving circuit as set forth in claim 11, wherein the display data are black display data or white display data.

16. The display device driving circuit as set forth in claim 12, wherein the display data are black display data or white display data.

17. The display device driving circuit as set forth in claim 11, wherein the display data are any one of red monochrome display data, blue monochrome display data, and green monochrome display data, or red complementary color display data, blue complementary color display data, and green complementary color display data.

18. The display device driving circuit as set forth in claim 12, wherein the display data are any one of red monochrome display data, blue monochrome display data, and green monochrome display data, or red complementary color display data, blue complementary color display data, and green complementary color display data.

19. The display device driving circuit as set forth in claim 15, wherein the display data are halftone display data.

20. The display device driving circuit as set forth in claim 16, wherein the display data are halftone display data.

21. The display device driving circuit as set forth in claim 17, wherein the display data are halftone display data.

22. The display device driving circuit as set forth in claim 18, wherein the display data are halftone display data.

23. A display device, comprising pixels and a driving circuit, wherein:

the driving circuit includes supply control circuits each of which supplies a precharge voltage for precharging and a video signal voltage corresponding to an inputted video signal to each of source bus lines connected to the pixels, and each of the supply control circuits includes: a sampling circuit section for supplying the video signal voltage to the source bus line in response to a sampling control signal for writing data of the pixels on the source bus line; and a precharge circuit section for supplying the video signal voltage and the precharge voltage to the source bus line via at least a switch that is controlled by the sampling control signal and one or more precharge control signals for precharging the source bus line, wherein the sampling circuit section and the precharge circuit section simultaneously supply the video signal voltage to the source bus line in response to the sampling control signal.

24. A display device driving method, in which a sampling control signal and a precharge control signal are inputted to switch circuits provided on each of source bus lines connected to pixels of a display device so as to cause a precharge voltage for precharging and a video signal voltage corresponding to an inputted video signal to or not to be supplied to the source bus line, said method comprising:

a precharging step in which the precharge control signal is simultaneously inputted to a first group of the switch circuits so as to supply the precharge voltage to the source bus line so that the source bus line is precharged; and a writing step in which the sampling control signal is inputted to a second group of one or more switch circuits fewer than the switch circuits of the first group so as to supply the video signal voltage to the pixels via the source bus line, wherein:

each of the switch circuits includes a plurality of switches, and first switches each of which is a part of the switches are controlled by the sampling control signal and the precharge control signal so as to be turned ON in response to the precharge control signal in the precharging step and so as to be turned ON in response to the sampling control signal in the writing step, second switches each of which is other part of the switches are turned ON in response to the sampling control signal in the writing step, and a number of the first switches turned ON in the precharging step and a number of the first and second switches turned ON in the writing step are different from each other, wherein the first switches and the second switches simultaneously supply the video signal voltage to the source bus line in response to the sampling control signal.

25. The display device driving circuit as set forth in claim 1, wherein a current supplying ability which enables a current to be supplied to the source bus line via the precharge circuit section is lower than a current supplying ability which enables the current to be supplied to the source bus line via both the sampling circuit section and the precharge circuit section.

* * * * *